US008109587B2

(12) United States Patent
Ishizaki

(10) Patent No.: US 8,109,587 B2
(45) Date of Patent: Feb. 7, 2012

(54) CAPACITIVE LOAD DRIVING CIRCUIT AND LIQUID DROPLET JETTING APPARATUS

(75) Inventor: Sunao Ishizaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 535 days.

(21) Appl. No.: 12/401,001

(22) Filed: Mar. 10, 2009

(65) Prior Publication Data

US 2010/0045714 A1 Feb. 25, 2010

(30) Foreign Application Priority Data

Aug. 25, 2008 (JP) ..... 2008-215666

(51) Int. Cl.
*B41J 29/38* (2006.01)
*G05F 1/00* (2006.01)

(52) U.S. Cl. ..... 347/9; 347/12; 323/283

(58) Field of Classification Search ..... 347/9–12; 323/283

See application file for complete search history.

(56) References Cited

U.S. PATENT DOCUMENTS

| | | | | |
|---|---|---|---|---|
| 7,244,007 | B2 * | 7/2007 | Ishizaki | 347/5 |
| 7,571,989 | B2 * | 8/2009 | Ishizaki | 347/57 |
| 7,798,591 | B2 * | 9/2010 | Ishizaki | 347/14 |
| 7,850,265 | B2 * | 12/2010 | Ishizaki | 347/9 |
| 2005/0231179 | A1 * | 10/2005 | Ishizaki | 323/234 |
| 2007/0079710 | A1 * | 4/2007 | Ishizaki | 101/189 |
| 2007/0165074 | A1 * | 7/2007 | Ishizaki | 347/57 |
| 2008/0042632 | A1 * | 2/2008 | Chapuis et al. | 323/283 |
| 2008/0170090 | A1 * | 7/2008 | Oshima | 347/10 |
| 2009/0140780 | A1 * | 6/2009 | Miyazaki et al. | 327/112 |
| 2009/0160891 | A1 * | 6/2009 | Ishizaki | 347/10 |

FOREIGN PATENT DOCUMENTS

| | | |
|---|---|---|
| JP | 2005-329710 | 12/2005 |
| JP | 2007-096364 | 4/2007 |
| JP | 2007-168172 | 7/2007 |
| JP | 2007-218782 | 8/2007 |

* cited by examiner

*Primary Examiner* — Julian Huffman
(74) *Attorney, Agent, or Firm* — Fildes & Outland, P.C.

(57) ABSTRACT

A capacitive load driving circuit including: a filter including an inductor to which an analog driving signal is input, and a capacitor with a fixed capacitance where one electrode is connected the inductor and other electrode grounded; a plurality of capacitive loads connected in parallel to the capacitor, and driven in accordance with the analog driving signal; a conversion section converting a load voltage to a digital signal; a signal processing section generating a predetermined signal for driving the capacitive load, deriving a signal that represents a magnitude of an electric current flowing to the capacitive load from the digital signal and a digital driving signal, subtracting the signal from the predetermined signal, and outputting the subtracted signal as the digital driving signal; and a switching section generating the analog driving signal by performing switching based on the digital driving signal, and outputting the analog driving signal.

9 Claims, 21 Drawing Sheets

CAPACITIVE LOAD DRIVING CIRCUIT AND LIQUID DROPLET JETTING APPARATUS

CROSS-REFERENCE TO RELATED APPLICATION

This application is based on and claims priority under 35 USC 119 from Japanese Patent Application No. 2008-215666 filed Aug. 25, 2008.

BACKGROUND

1. Technical Field

The invention relates to a capacitive load driving circuit and a liquid droplet jetting apparatus.

2. Related Art

An ink jet head driving circuit, in the related art, feeds an analog driving signal to a piezoelectric device provided in a piezoelectric head, and ejects an ink droplet from a nozzle provided corresponding to the piezoelectric device. Since the piezoelectric device is a capacitive device, when the number of the piezoelectric devices driven at the same time increases, a capacitance (the load of the driving circuit) becomes larger. As a result, the waveform of the driving signal input to the piezoelectric device changes and therefore stable operation may not be realized.

SUMMARY

According to an aspect of the invention, there is provided a capacitive load driving circuit including: a filter that includes an inductor, an analog driving signal being input to one end of the inductor, and a capacitor with a fixed capacitance having one electrode connected to the other end of the inductor and the other electrode connected to ground; a plurality of capacitive loads connected in parallel to the capacitor, any of which may be driven in accordance with the analog driving signal input to one end of the inductor; a conversion section that converts a load voltage output from the other end of the inductor to a digital signal; a signal processing section that generates a predetermined signal for driving the capacitive load, derives a signal representing a magnitude of an electric current flowing to the capacitive load based on the digital signal and a digital driving signal, subtracts the signal representing the magnitude of an electric current from the predetermined signal, and outputs the subtracted signal as the digital driving signal; and a switching section that generates the analog driving signal by performing switching based on the digital driving signal, and that outputs the analog driving signal to one end of the inductor.

BRIEF DESCRIPTION OF THE DRAWINGS

Exemplary embodiments of the present invention will be described in detail based on the following figures, wherein.

DETAILED DESCRIPTION

Exemplary embodiments will be described below in detail with reference to the drawings.

First Exemplary Embodiment

The entire configuration of an ink jet printer 1 according to the first exemplary embodiment will be described, by referring to FIG. 1.

Figure 1:
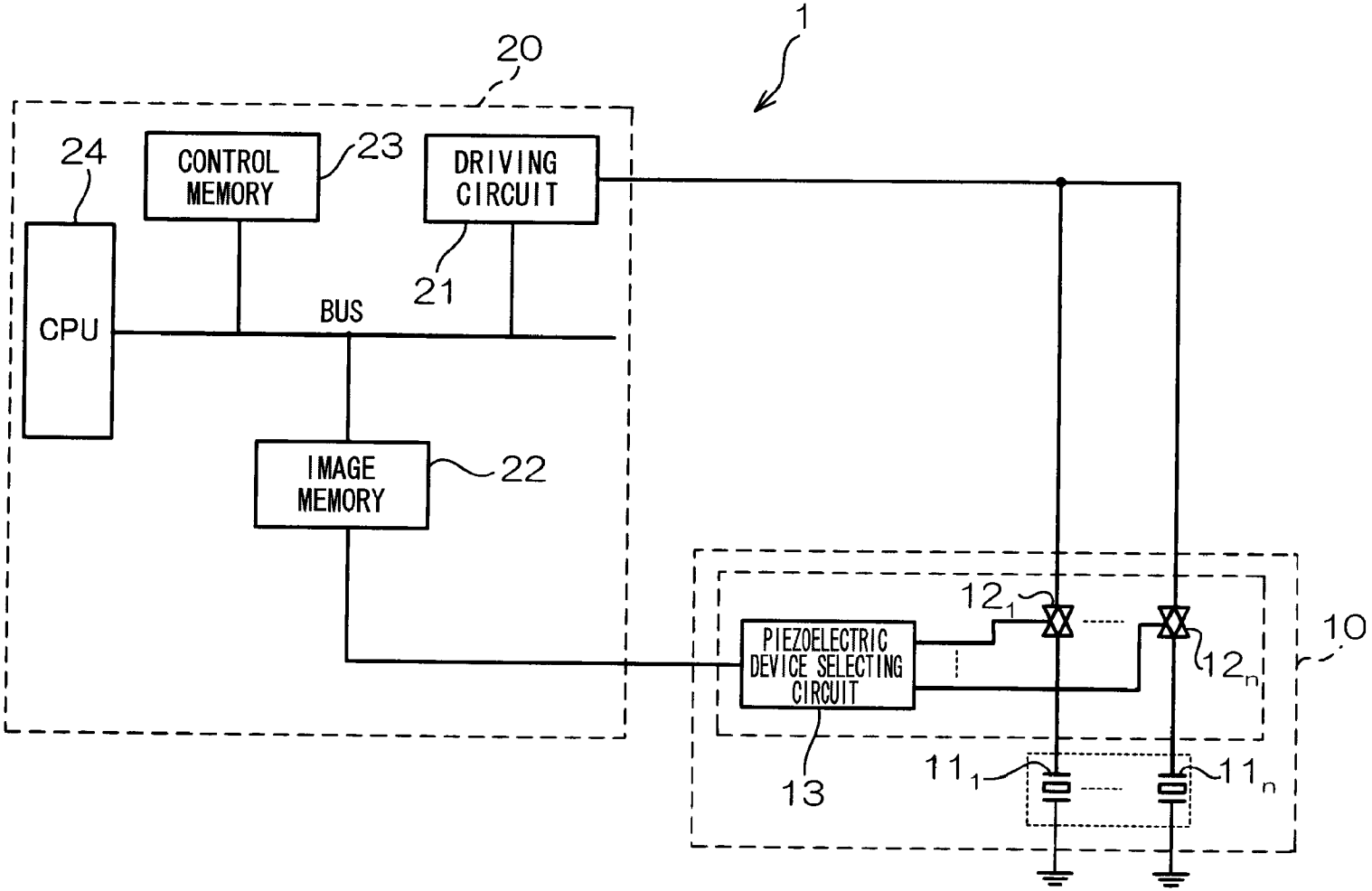
FIG. 1 is a block diagram showing the configuration of an ink jet printer according to a first exemplary embodiment.

FIG. 1 is a block diagram showing the configuration of the ink jet printer 1 according to an exemplary embodiment. The ink jet printer 1 includes a piezoelectric head 10 that ejects ink, and a control unit 20 that controls the ejection of the ink.

The piezoelectric head 10 includes: integrated jetting devices that include n (n is a natural number) piezoelectric devices $\mathbf{11}_1$ to $\mathbf{11}_n$, as capacitive loads; n transmission gates $\mathbf{12}_1$ to $\mathbf{12}_n$ that are connected in series with the piezoelectric devices $\mathbf{11}_1$ to $\mathbf{11}_n$ and are switched on or off; and a piezoelectric device selecting circuit 13 that controls on or off of the transmission gates $\mathbf{12}_1$ to $\mathbf{12}_n$ to select the arbitrary piezoelectric devices $\mathbf{11}_1$ to $\mathbf{11}_n$.

The numerical subscripts (1 to n) of the reference numerals are used for discriminating the piezoelectric devices or the transmission gates. However, when they are need not be discriminated, the numerical subscripts are omitted.

Figure 2:
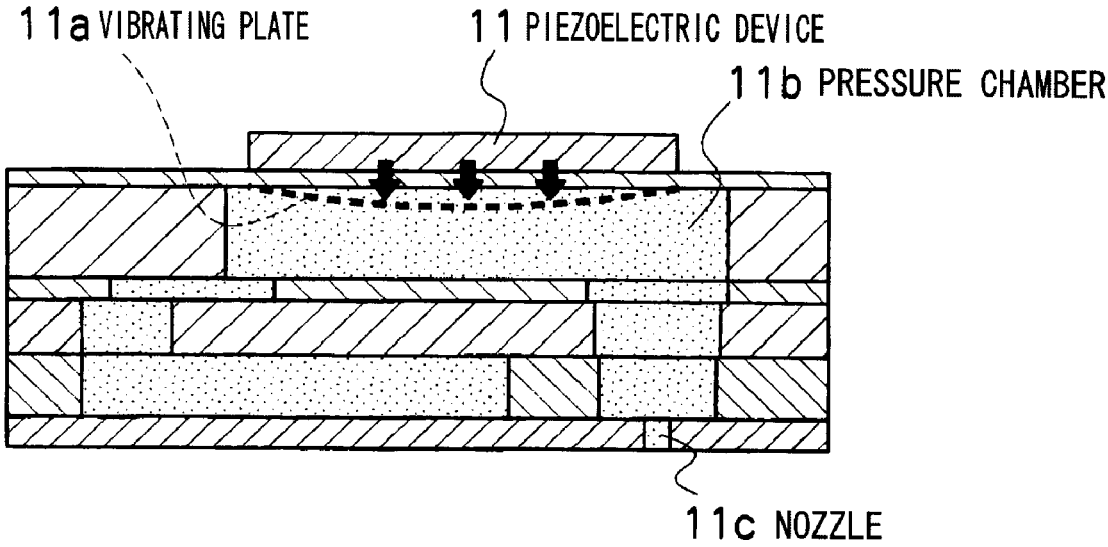
FIG. 2 is a diagram showing the configuration of a jetting apparatus according to the first exemplary embodiment.

FIG. 2 is a diagram showing the configuration of the jetting device. The piezoelectric head 10 integrates several hundred to thousand of jetting device that is shown in FIG. 2. In each of the jetting device, when a voltage is applied to the piezoelectric device 11, a vibrating plate 11*a* vibrates according to the fluctuation of the piezoelectric device 11. Due to the vibration, the volume of a pressure chamber 11*b* in which an ink liquid is filled changes. Due to the volume change, the liquid droplet is jetted from a nozzle 11*c*.

The control unit 20 includes: a driving circuit 21 that drives the piezoelectric head 10; an image memory 22 that stores image data; a control memory 23 that stores control data; and a CPU (Central Processing Unit) 24 that manages the entire control. Further, the above components are connected via a bus.

The CPU 24 uses the control data stored in the control memory 23 to generate an analog driving signal for allowing the driving circuit 21 to drive the piezoelectric device 11. The CPU 24 controls the piezoelectric device selecting circuit 13 of the piezoelectric head 10 based on the image data stored in the image memory 22. The control is performed by selecting the jetting device and turning on the transmission gate 12 corresponding to the selected jetting device.

Figure 3:
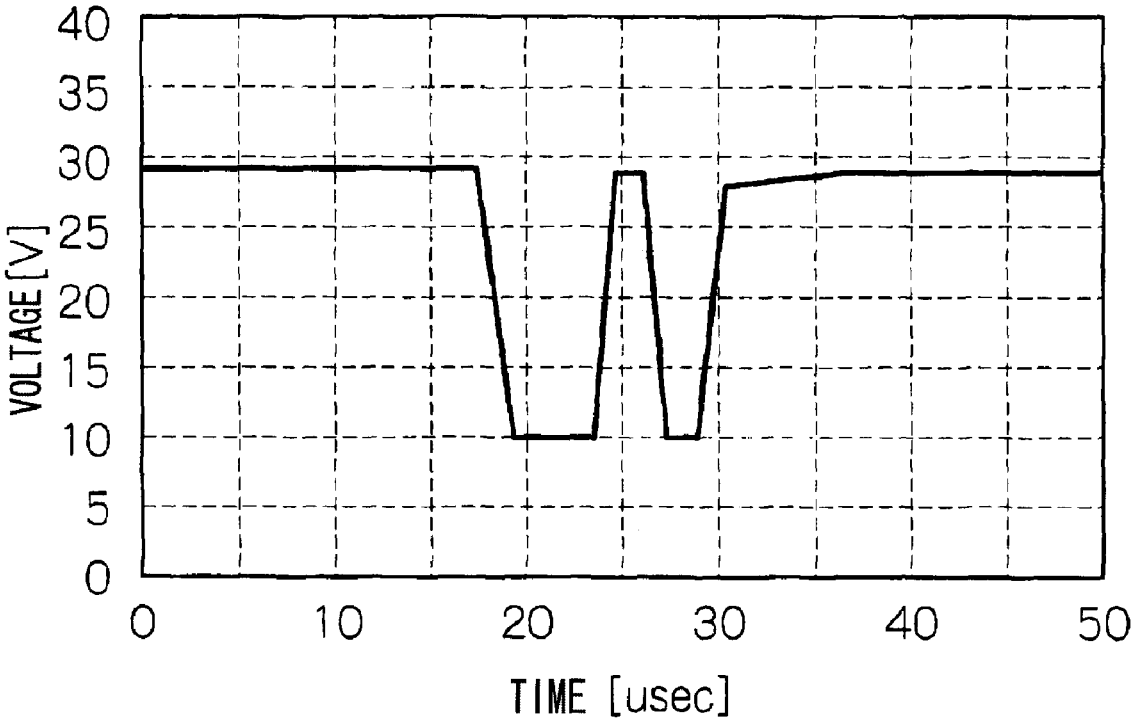
FIG. 3 is a diagram showing an analog driving signal according to the first exemplary embodiment.

The driving circuit 21 feeds the analog driving signal shown in FIG. 3 to the piezoelectric head 10. As the jetting frequency increases, the frequency range of the analog driving signal becomes wider, reaching several hundred kHz in the example shown in FIG. 3.

Figure 4:
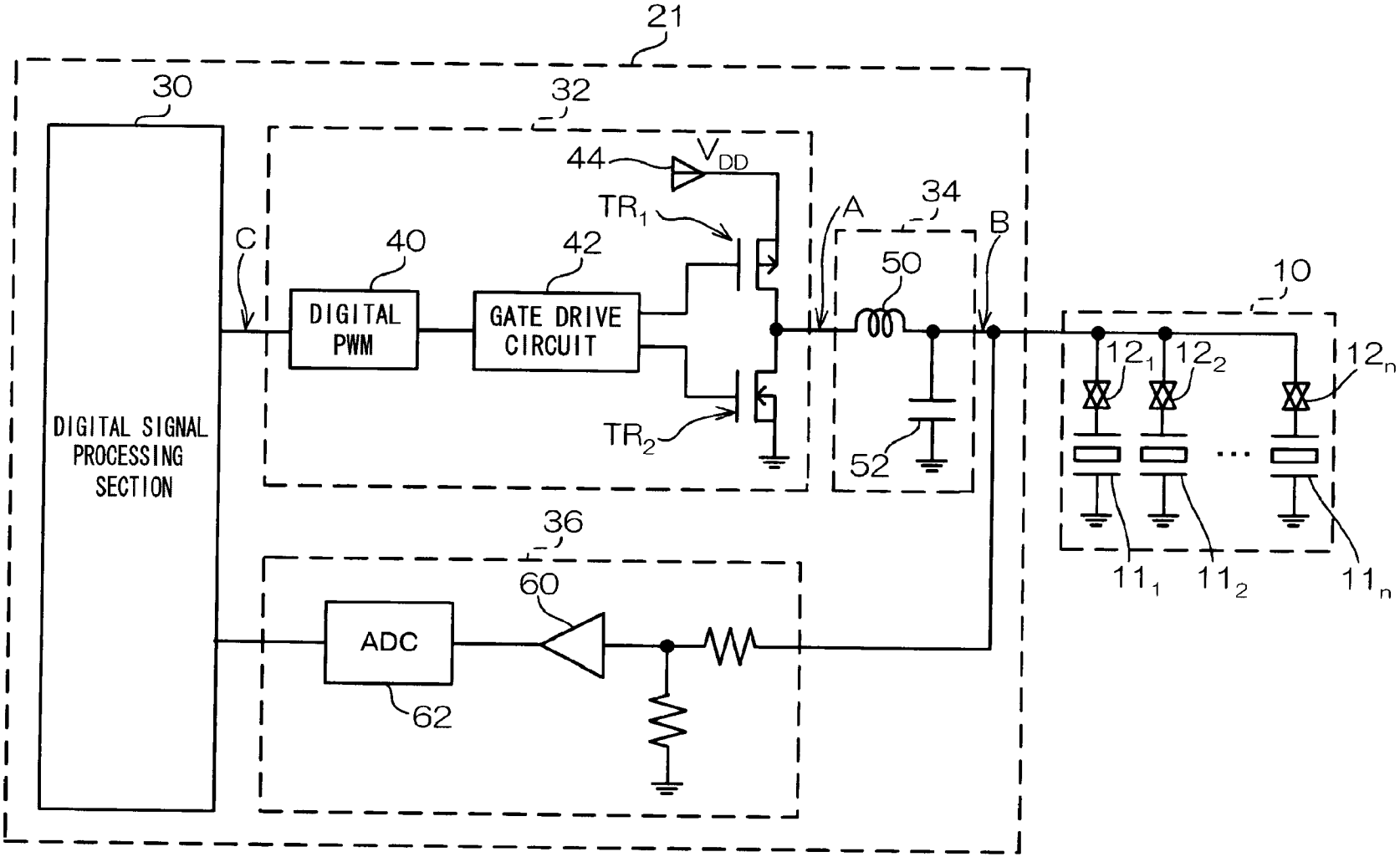
FIG. 4 is a diagram showing the configuration of a driving circuit according to the first exemplary embodiment.

FIG. 4 shows the configuration of the driving circuit 21.

The driving circuit 21 includes: a digital signal processing section 30; a switching voltage amplifying circuit 32; a filter 34; and a voltage detecting circuit 36.

The digital signal processing section 30 outputs a digital driving signal for driving the piezoelectric device 11 to the switching voltage amplifying circuit 32.

The switching voltage amplifying circuit 32 includes a digital pulse width modulating circuit 40 (hereinafter, called a "digital PWM 40"), a gate drive circuit 42, and a first transistor $TR_1$ and a second transistor $TR_2$ configured by MOSFETs. The switching voltage amplifying circuit 32 performs switching operation based on the digital driving signal output from the digital signal processing section 30, to generate the analog driving signal.

The input terminal of the digital PWM 40 is connected to the output terminal of the digital signal processing section 30. The digital driving signal is inputted to the input terminal, modulated to a predetermined pulse width and is then outputted.

The output terminal of the digital PWM 40 is connected to the input terminal of the gate drive circuit 42. Further, a first output terminal of the gate drive circuit 42 is connected to the gate of the first transistor $TR_1$. Thus, a second output terminal of the gate drive circuit 42 is connected to the gate of the second transistor $TR_2$.

A voltage $V_{DD}$ outputted from a high voltage power supply 44 is applied to the source of the first transistor $TR_1$. The drain of the first transistor $TR_1$ is connected to the drain of the second transistor $TR_2$. The source of the second transistor $TR_2$ is grounded. The drain of the first transistor $TR_1$ (the drain of the second transistor $TR_2$) is the output terminal of the switching voltage amplifying circuit 32. The output terminal of the switching voltage amplifying circuit 32 is connected to the input terminal of the filter 34.

The gate drive circuit 42 amplifies the amplitude of the digital driving signal output from the digital PWM 40 to a voltage that operates the transistors $TR_1$ and $TR_2$. When a pulse signal from the digital PWM 40 is a logic '1', the gate drive circuit 42 outputs a voltage that turns on the transistor $TR_1$ and outputs a voltage that turns off the transistor $TR_2$. Further, when the pulse signal is a logic '0', the gate drive circuit 42 outputs a voltage that turns off the transistor $TR_1$ and outputs a voltage that turns on the transistor $TR_2$. Then, the transistors $TR_1$ and $TR_2$ can complementarily perform switching operation according to the pulse signal output from the gate drive circuit 42. A voltage $V_1$ outputted from the output terminal of the switching voltage amplifying circuit 32 is equal to the voltage $V_{DD}$ except for the voltage drop due to channel resistance. Note that the signals of the voltage $V_1$ is the analog driving signal.

In the switching voltage amplifying circuit 32, the maximum input voltage is $V_T$ and the maximum output voltage is the voltage $V_{DD}$. Accordingly, a voltage amplification factor $g_V$ of the switching voltage amplifying circuit 32 can be expressed by Expression (2).

$$g_v = \frac{V_{DD}}{V_T} \tag{2}$$

The filter 34 has an inductor 50, and a capacitor 52 that has a fixed capacitance. The analog driving signal is inputted to one end of the inductor 50. The capacitor 52 has one electrode connected to the other end of the inductor 50, and the other electrode grounded. The filter 34 removes the carrier component of the input analog driving signal.

The piezoelectric devices $\mathbf{11}_1$ to $\mathbf{11}_n$ are connected in parallel with the capacitor 52. The frequency characteristics of the filter 34 is determined by an inductance L of the inductor 50, a capacitance $C_0$ of the capacitor 52, and a capacitance $C_L$ that is changed according to the number of the driven piezoelectric devices $\mathbf{11}_1$ to $\mathbf{11}_n$.

Figure 5:
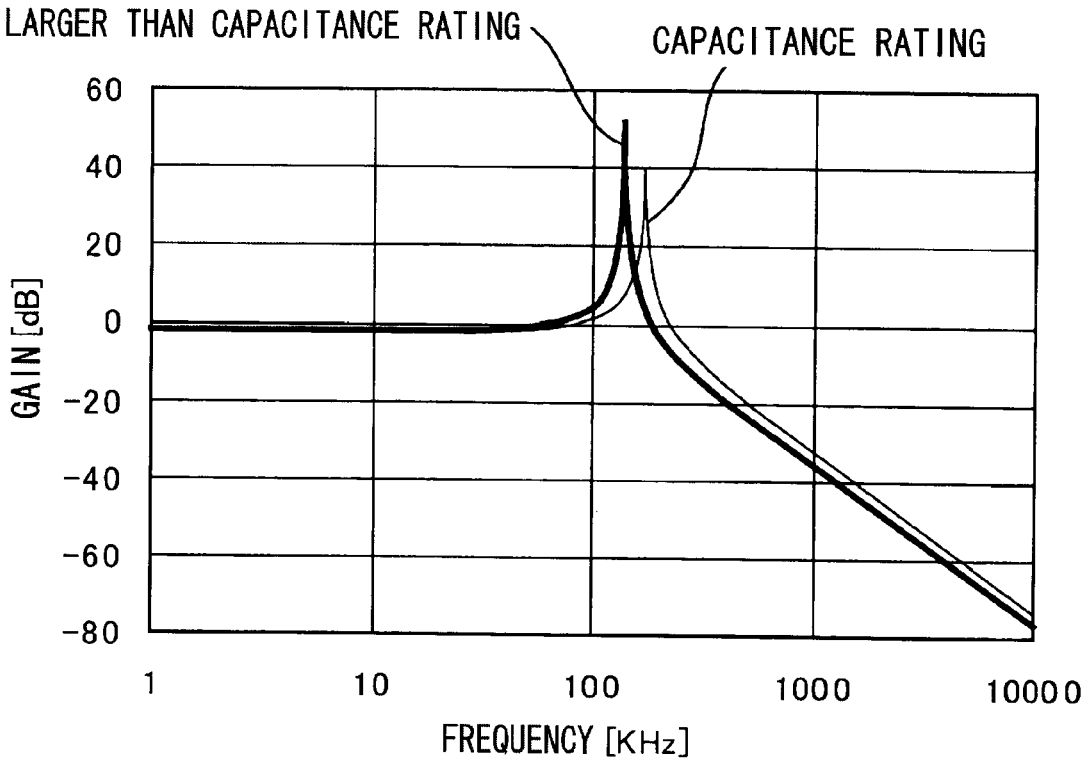
FIG. 5 is a graph showing an example of the frequency characteristics of a filter according to the first exemplary embodiment.

FIG. 5 is an example of a graph showing the frequency characteristics of the filter 34 according to this exemplary embodiment.

As shown in the FIG. 5, the filter 34 according to this exemplary embodiment has a characteristic that is resonant at frequencies more than 100 kHz. Further, the magnitude of the frequency causing resonance may change according to the magnitude of the capacitance $C_L$.

Here, the total of the capacitance $C_0$ of the capacitor 52 and the capacitance $C_L$ changed according to the number of the driven piezoelectric devices 11 is a capacitance C. Accordingly, a resonant frequency $f_0$ of the filter 34 can be expressed by Expression (3). Further, an angular frequency $\omega_0$ of the filter 34 can be expressed by Expression (4).

$$f_0 = \frac{1}{2\pi\sqrt{LC}} \tag{3}$$

$$\omega_0 = 2\pi f_0 \tag{4}$$

Namely, a transfer function F(s) from an input A to an output B of the filter 34 (see FIG. 4) can be expressed by Expression (5).

$$F(s) = \frac{\omega_0^2}{s^2 + \omega_0^2} \tag{5}$$

Here "s" is a Laplace variable and the relation between frequency f can be defined as Expression (6).

$$s=j2\pi f, j=\sqrt{-1} \tag{6}$$

Here, a transfer function from an input C of the switching voltage amplifying circuit 32 to the output B of the filter 34 is P(s). Accordingly, P(s) can be expressed by Expression (7) as the product of Expressions (2) and (5).

$$P(s) = g_v F(s) = \frac{g_v \omega_0^2}{s^2 + \omega_0^2} \tag{7}$$

Further, the output terminal of the filter 34 is connected to the voltage detecting circuit 36.

The voltage detecting circuit 36 divides the output voltage of the filter 34, that is, the voltage applied to the piezoelectric device 11 (hereinafter, called a "load voltage"), by the resistors $R_1$ and $R_2$, and converts the load voltage from an analog signal to a digital signal by an analog-digital converter (hereinafter, called an "ADC") 62 via a buffer amplifier 60. Further, the voltage detecting circuit 36 outputs the load voltage converted to the digital signal (hereinafter, called a "digital load voltage signal") to the digital signal processing section 30.

The characteristic of the filter 34 expressed by Expression (7) has the resonant characteristic as shown in FIG. 5 as an example. To suppress the resonant characteristic (hereinafter, called "stabilization"), the driving circuit 21 according to this exemplary embodiment includes a stabilizing compensator in the digital signal processing section 30.

To perform the stabilization, the load voltage is differentiated and the differentiated load voltage is used for feedback.

Here, the divided voltage ratio of the voltage detecting circuit 36 is expressed as $g_S$ and the feedback gain is expressed as $T_D$. Accordingly, a transfer function H(s) of the stabilizing compensator can be expressed by Expression (8). Further, a transfer function Q(s) of the filter 34 and the stabilizing compensator can be expressed by Expression (9). Hereafter, the Q(s) expressed by Expression (9) will be called "control target".

$$H(s) = g_s T_D s \tag{8}$$

$$Q(s) = \frac{g_s g_V \omega_0^2}{s^2 + g_s T_D s + \omega_0^2} \tag{9}$$

However, since the differentiating operation is performed by the digital signal processing, the small changes of the load voltage may be sensitively responded.

Namely, an electric current flowing to the piezoelectric device 11 is in proportion to the differentiated value of the load voltage. Due thereto, the electric current is detected and the value of the detected electric current is used to perform the feedback. However, to detect the electric current flowing to the piezoelectric device 11, the device configuration may be come complicated.

Due thereto, in the driving circuit 21 according to this exemplary embodiment, the stabilizing compensator is configured as a state estimator that estimates (derives) the magnitude of the electric current, flowing to the piezoelectric device 11, from the digital driving signal and the digital load voltage signal.

Figure 6:
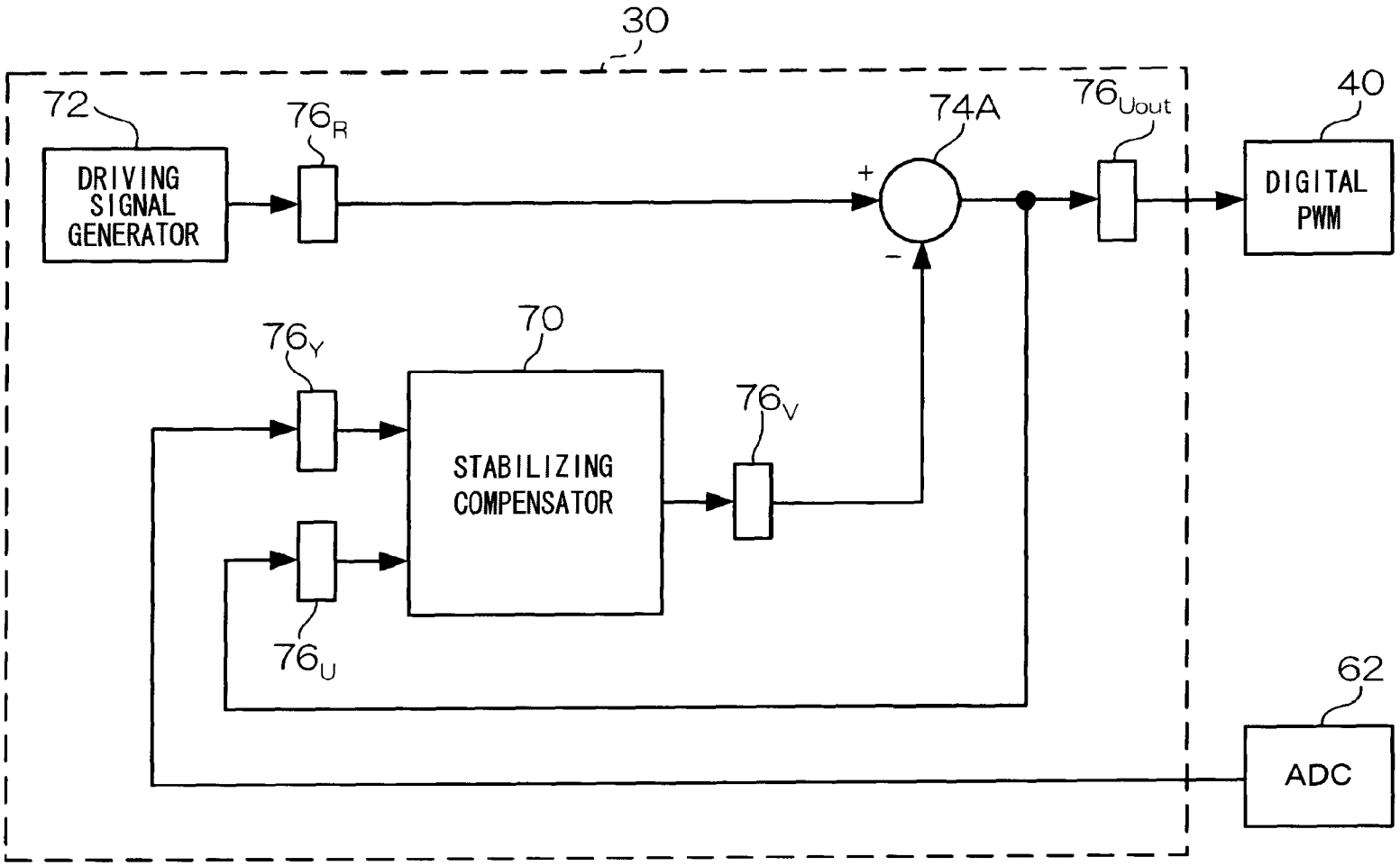
FIG. 6 is a diagram showing the configuration of a digital signal processing section according to the first exemplary embodiment.

Hereafter, referring to FIG. 6, the essential configuration of the electric system of the digital signal processing section 30 including a stabilizing compensator 70 configured as the state estimator will be described.

The digital signal processing section 30 includes the stabilizing compensator 70, a driving signal generator 72, and an adder-subtractor 74A.

The driving signal generator 72 generates a predetermined digital signal $D_0$ for driving the piezoelectric device 11. The digital signal $D_0$ generated by the driving signal generator 72 is stored in a register $\mathbf{76}_R$.

The adder-subtractor 74A subtracts a digital signal showing the magnitude of an electric current flowing to the piezoelectric device 11 derived by the stabilizing compensator 70 (hereinafter, called a "digital load current signal") from the digital signal $D_0$ stored in the register $\mathbf{76}_R$. Accordingly, the adder-subtractor 74A derives the digital driving signal. Then the digital driving signal derived by the adder-subtractor 74A is stored in a register $\mathbf{76}_{Uout}$ and a register $\mathbf{76}_U$.

The stabilizing compensator 70 is connected to a register $\mathbf{76}_Y$ that stores the digital load voltage signal output from the ADC 62 and is connected to a register $\mathbf{76}_U$ that stores the digital driving signal output from the adder-subtractor 74A. Further, the stabilizing compensator 70 derives the digital load current signal based on the digital load voltage signal and the digital driving signal.

The stabilizing compensator 70 according to this exemplary embodiment calculates the digital load current signal from the state equation expressed by Expression (10). Here, the load voltage is $x_1$, the value in proportion to the magnitude of the electric current flowing to the piezoelectric device 11 is $x_2$, the state vector configured by $x_1$ and $x_2$ is x, the voltage shown by the digital driving signal is u, the system matrix determined by the capacitance C of the capacitor 52 and the piezoelectric device 11 and the inductance L of the inductor 50 is A, and the vector configured by a coefficient showing the relation between the load voltage and the state vector x is B.

$$\frac{dx}{dt} = Ax + Bu \tag{10}$$

Further, the state equation expressed by Expression (10) can be expressed by Expression (11) by using the transfer function of the filter 34 expressed by Expression (4).

$$\frac{d}{dt}\begin{bmatrix} x_1 \\ x_2 \end{bmatrix} = \begin{bmatrix} 0 & 1 \\ -\omega^2 & 0 \end{bmatrix}\begin{bmatrix} x_1 \\ x_2 \end{bmatrix} + \begin{bmatrix} 0 \\ g_s g_v \omega_0^2 \end{bmatrix} u, \quad y = \begin{bmatrix} 1 & 0 \end{bmatrix}\begin{bmatrix} x_1 \\ x_2 \end{bmatrix} \tag{11}$$

The stabilizing compensator 70 according to this exemplary embodiment derives $x_2$ expressed by Expression (11) as the digital load current signal. Note that the digital load current signal derived by the stabilizing compensator 70 is stored in a register $\mathbf{76}_V$.

Figure 7:
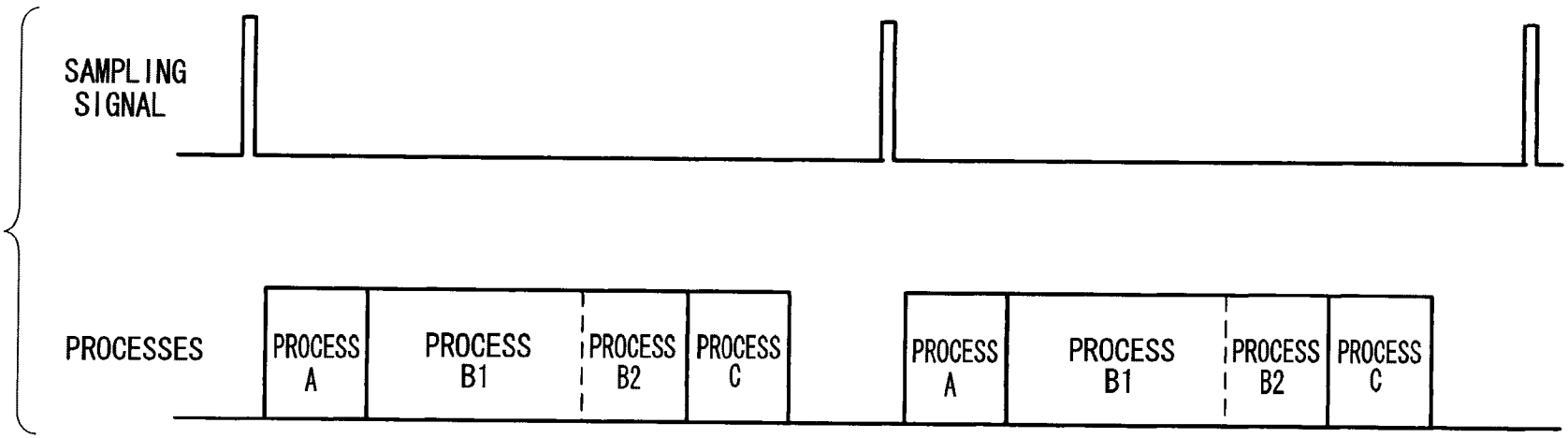
FIG. 7 is a diagram showing the order of processes according to the first exemplary embodiment.

Hereafter, referring to FIG. 7, the order of processes executed by the digital signal processing section 30 according to this exemplary embodiment will be described.

In process A, when a sampling signal is fed to the digital signal processing section 30, the digital load voltage signal stored in the register $\mathbf{76}_Y$ and the digital driving signal stored in the register $\mathbf{76}_U$ are outputted to the stabilizing compensator. Then the routine proceeds to process B1.

In process B1, the digital load current signal is derived by the stabilizing compensator 70 by computation and is stored in the register $76_V$. Then the routine proceeds to process B2.

In process B2, the digital load current signal stored in the register $76_V$ and the digital signal $D_0$ stored in the register $76_R$ are outputted to the adder-subtractor 74A. Then, the digital load current signal is subtracted from the digital signal $D_0$ by the adder-subtractor 74A and is stored in the register $76_{Uout}$ and the register $76_U$. Then the routine proceeds to process C.

In process C, the digital driving signal stored in the register $76_{Uout}$ is outputted to the digital PWM 40.

Figure 8:
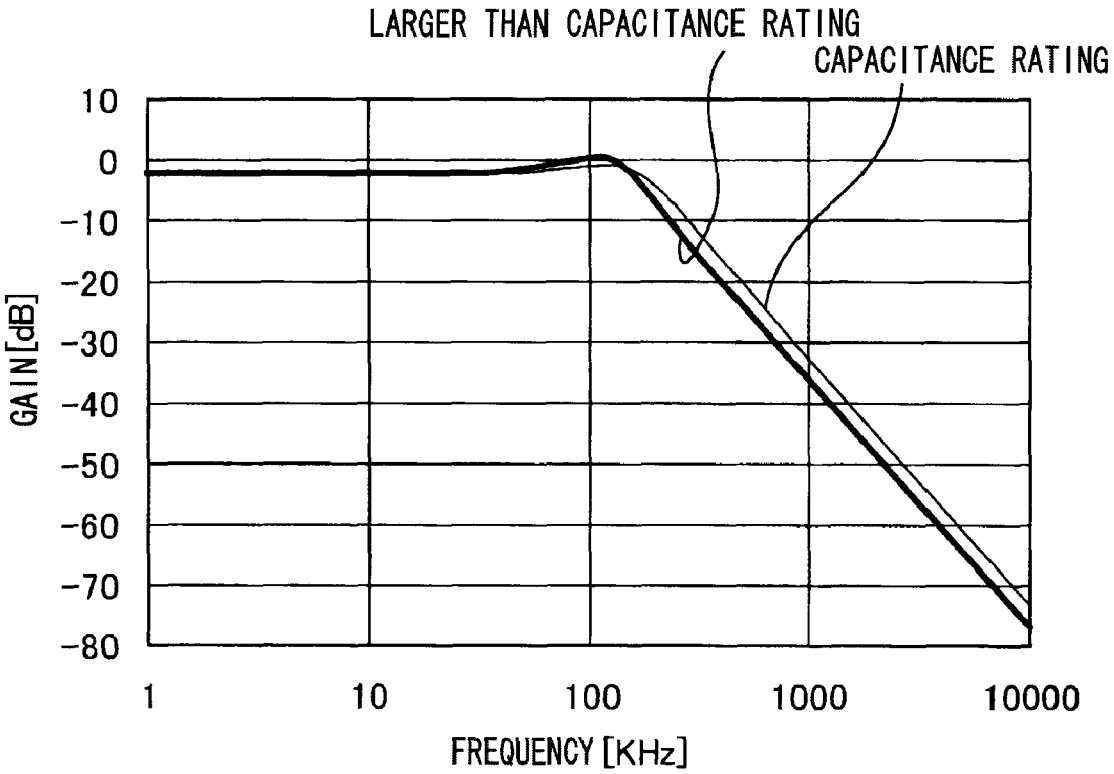
FIG. 8 is a graph showing an example of the frequency characteristics of a control target Q(s) according to the first exemplary embodiment.

FIG. 8 is a graph showing an example of the frequency characteristics of the control target Q(s) when feedback is performed to the filter 34 of this exemplary embodiment by using the stabilizing compensator 70. From FIG. 8, it can be understood that resonance is suppressed, compared to the graph of frequency characteristics shown in FIG. 5. Accordingly, the stabilized system functions as a low-pass filter that has a cutoff frequency around 100 kHz. Note that, when the magnitude of the capacitance $C_L$ changes, the frequency characteristics of the low-pass filter also changes.

Second Exemplary Embodiment

Hereinafter, a second exemplary embodiment in which the frequency range (100 kHz or more) of the analog driving signal suppressed by the filter 34 is enhanced, will be described.

Figure 9:
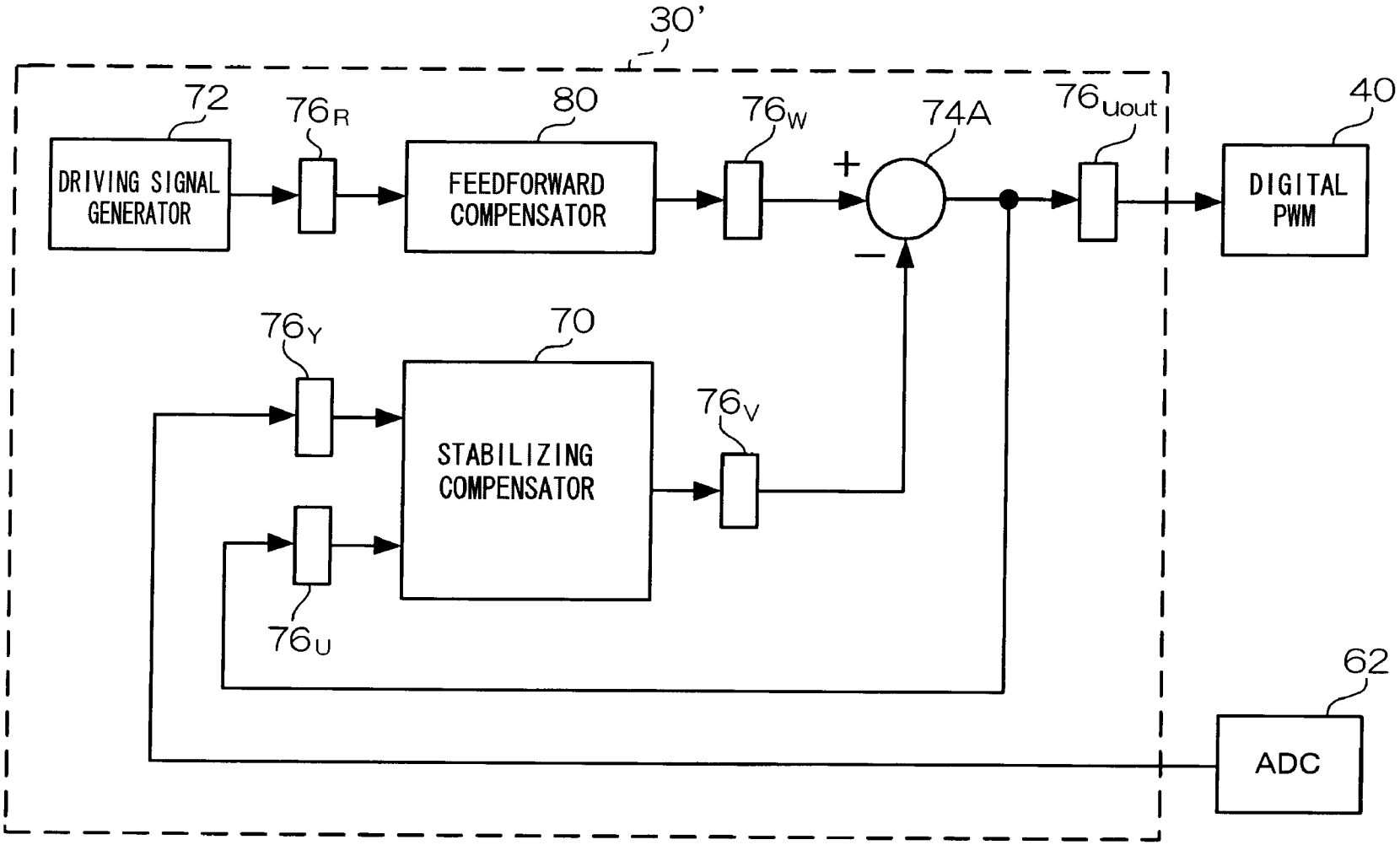
FIG. 9 is a diagram showing the configuration of a digital signal processing section according to a second exemplary embodiment.

Referring to FIG. 9, the essential configuration of the electric system of a digital signal processing section 30' according to the second exemplary embodiment will be described. The configurations of FIG. 9 that are the same to FIG. 4 are indicated by the same reference numerals as FIG. 4, and the description thereof will be omitted.

As shown in FIG. 9, the digital signal processing section 30' includes a feedforward compensator 80.

The input terminal of the feedforward compensator 80 is connected to the output terminal of the register $76_R$ and the digital signal $D_0$ is inputted to the feedforward compensator 80. On the other hand, the output terminal of the feedforward compensator 80 is connected to the input terminal of a register $76_W$ and the register $76_W$ stores a digital signal $D_W$ outputted from the feedforward compensator 80.

Figure 10:
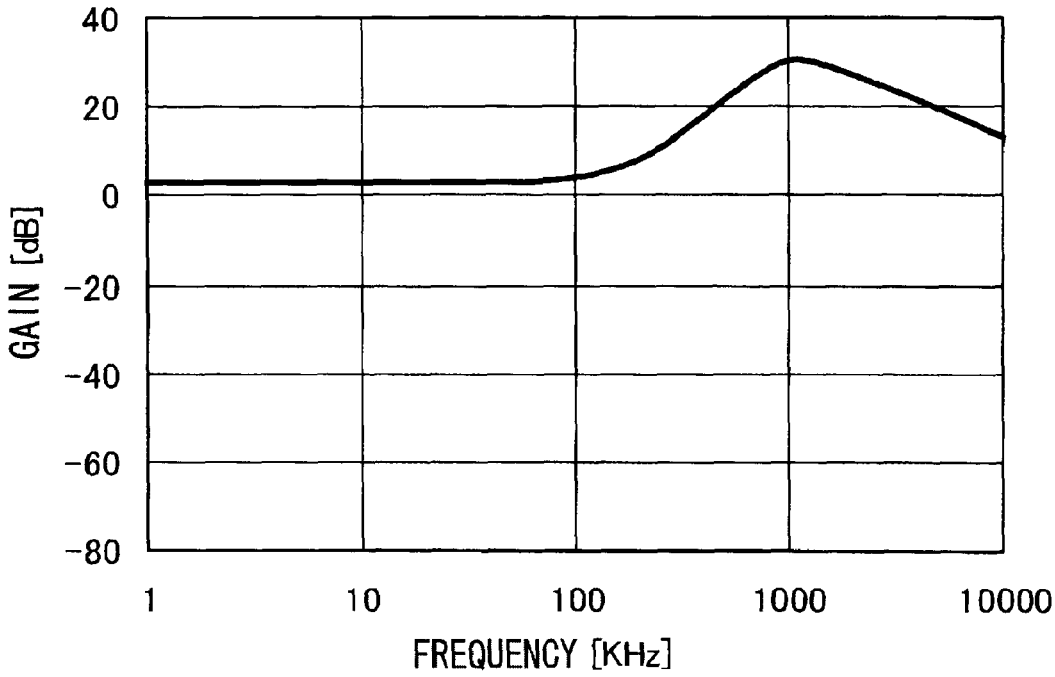
FIG. 10 is a graph showing an example of the frequency characteristics of a feedforward compensator according to the second exemplary embodiment.

FIG. 10 is a graph showing an example of the frequency characteristics of the feedforward compensator 80 according to the second exemplary embodiment. As shown in FIG. 10, the gain gradually increases from the frequency range in which the frequency exceeds 100 kHz, (hereinafter, called a "high frequency range") and peaks around 1000 kHz. Further, the gain gradually decreases at the frequency of 1000 kHz or more. The frequency characteristics shown in FIG. 10 include enhancement of the frequency range of the analog driving signal suppressed by the filter 34 having the frequency characteristics shown in FIG. 8.

Therefore, the feedforward compensator 80 has the frequency characteristics as shown in FIG. 10. Due thereto, the digital signal $D_0$ inputted to the feedforward compensator 80 is outputted as a digital signal $D_W$ including an enhanced high frequency range.

A transfer function D(s) of the feedforward compensator 80 can be expressed by Expression (12) which is a product of a transfer function N(s) of a low-pass filter 90 that has a cutoff frequency of several 100 kHz and the inverse number of Expression (9).

$$D(s)=N(s)Q^{-1}(s) \tag{12}$$

Figure 11:
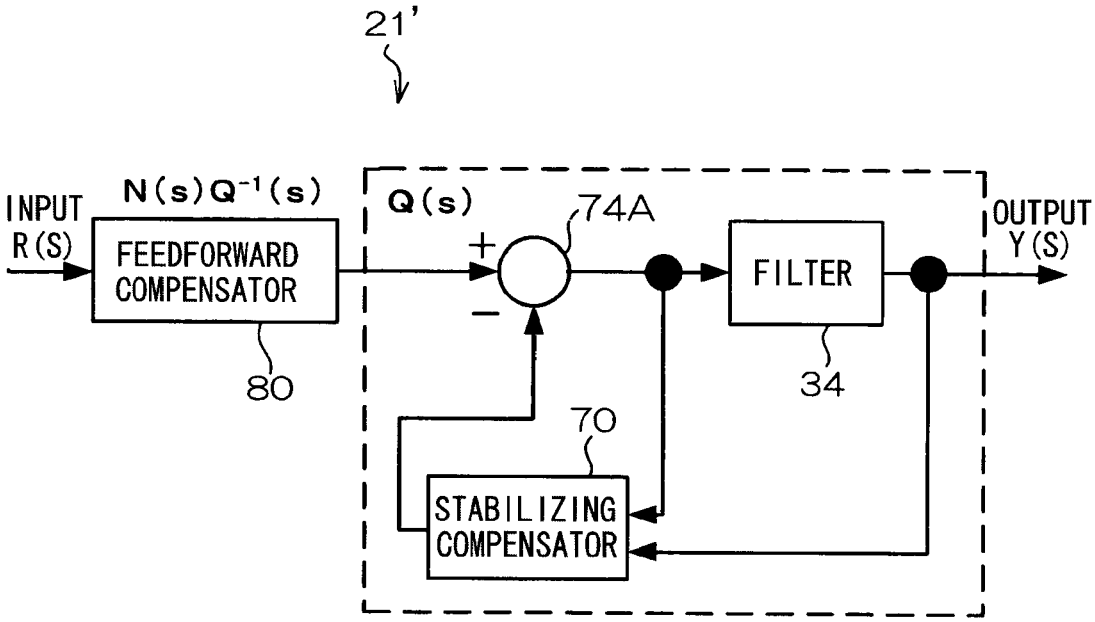
FIG. 11 is a diagram showing the transfer function of a driving circuit according to the second exemplary embodiment.

As can be understood from the diagram showing the transfer function of the circuits configuring a driving circuit 21', according to the second exemplary embodiment shown in FIG. 11, the transfer function form an input R(s) of the feedforward compensator 80 to an output Y(s) of the filter 34 can be expressed as transfer function N(s).

Figure 12:
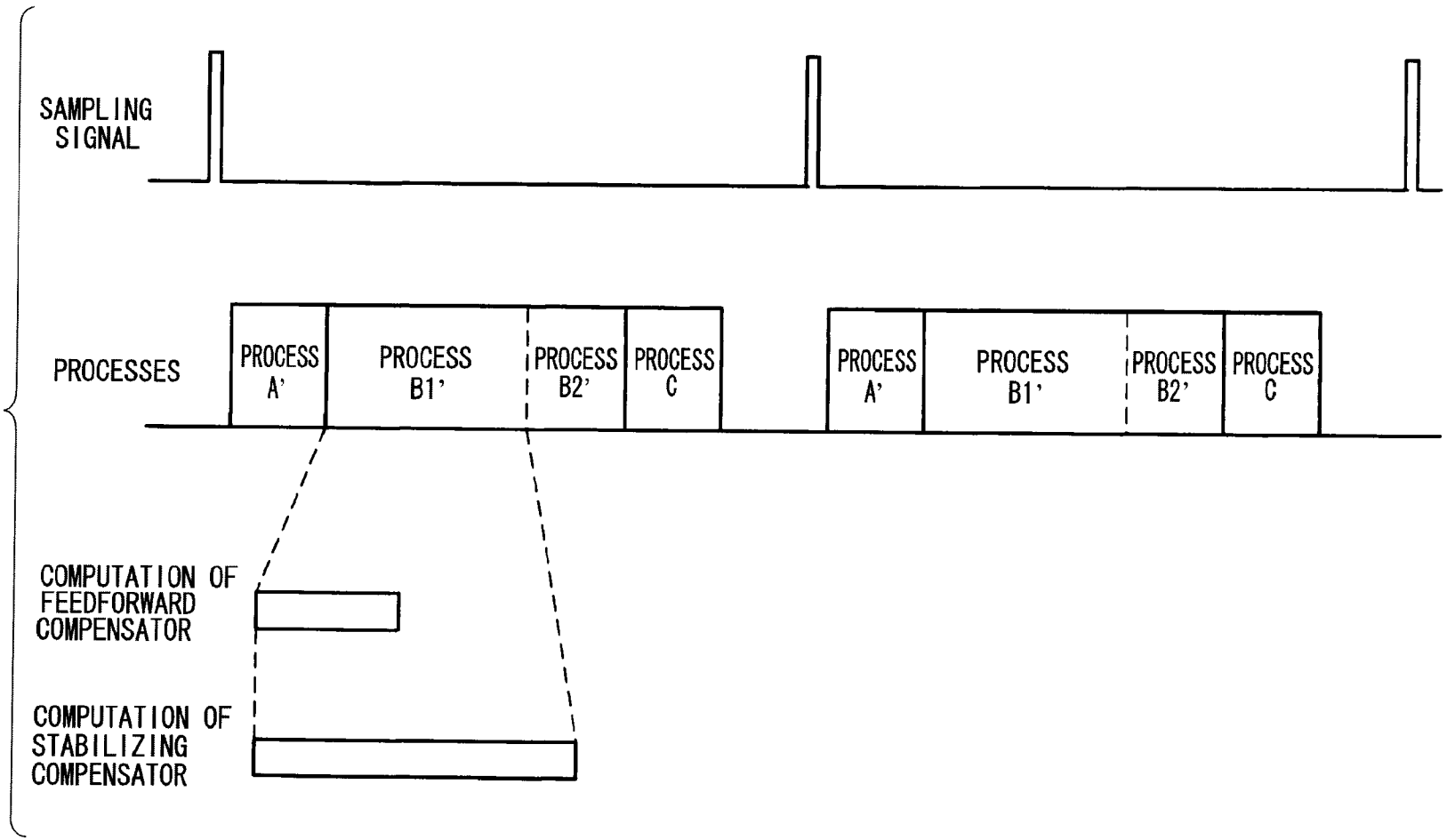
FIG. 12 is a diagram showing the order of processes according to the second exemplary embodiment.

Hereafter, referring to FIG. 12, a process executed by the digital signal processing section 30' according to the second exemplary embodiment will be described. The processes of FIG. 12 that are the same to FIG. 7 are indicated by the same reference numerals as FIG. 7, and the description thereof will be omitted.

In process A', the digital load voltage signal stored in the register $76_Y$ and the digital driving signal stored in the register $76_U$ are outputted to the stabilizing compensator 70. With this, the digital signal $D_0$ stored in the register $76_R$ is outputted to the feedforward compensator 80. Then, the routine proceeds to a process B1'.

In process B1', the digital load current signal is derived by the stabilizing compensator 70 by computation and is stored in the register $76_V$. Further, in the process B1', the computation to enhances the high frequency range with respect to the digital signal $D_0$ is performed by the feedforward compensator 80, and is stored in the register $76_W$. Note that, the computation of the stabilizing compensator 70 and the computation of the feedforward compensator 80 are executed in parallel. After both the computations are completed, the routine proceeds to process B2'.

In process B2', the digital load current signal stored in the register $76_V$ and the digital signal $D_W$ stored in the register $76_W$ are outputted to the adder-subtractor 74A. The digital load current signal is subtracted from the digital signal $D_W$ by the adder-subtractor 74A. Then, the digital driving signal derived by the subtraction is stored in the register $76_{Uout}$ and the register $76_U$. Then, the routine proceeds to the process C.

Figure 13:
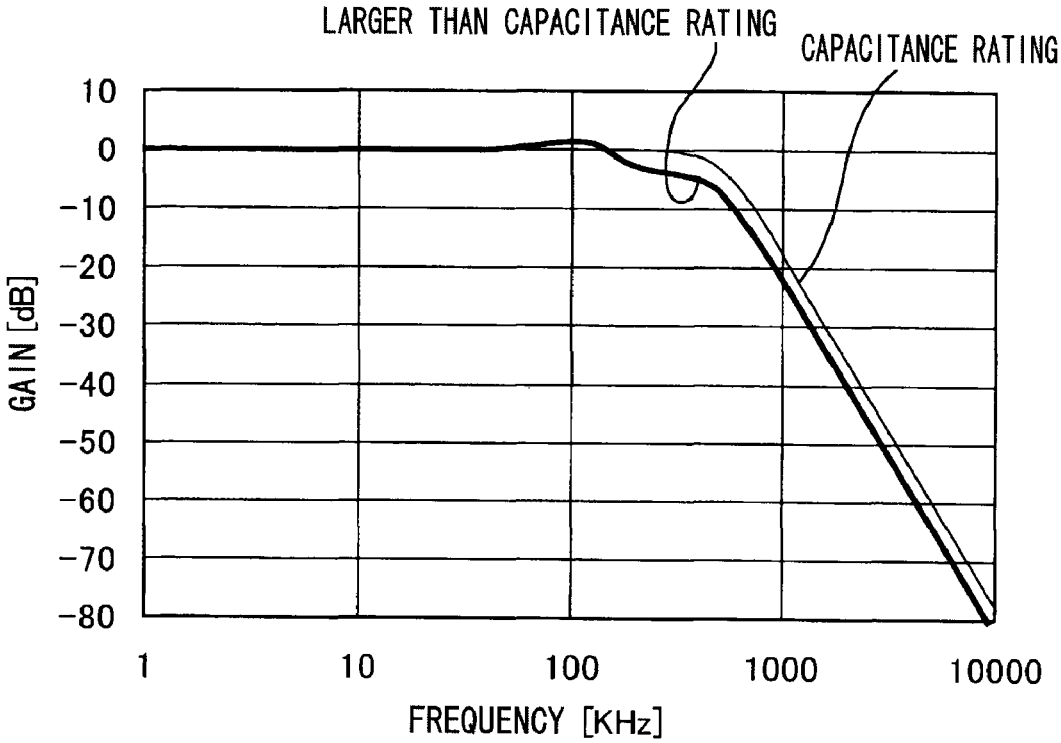
FIG. 13 is a graph showing an example of the frequency characteristics of the driving circuit according to the second exemplary embodiment.

FIG. 13 is a graph showing an example of the frequency characteristics of the system shown in FIG. 11. As shown in FIG. 13, in can be noticed that the cutoff frequency is higher than the graph of the frequency characteristics shown in FIG. 8.

Figure 14:
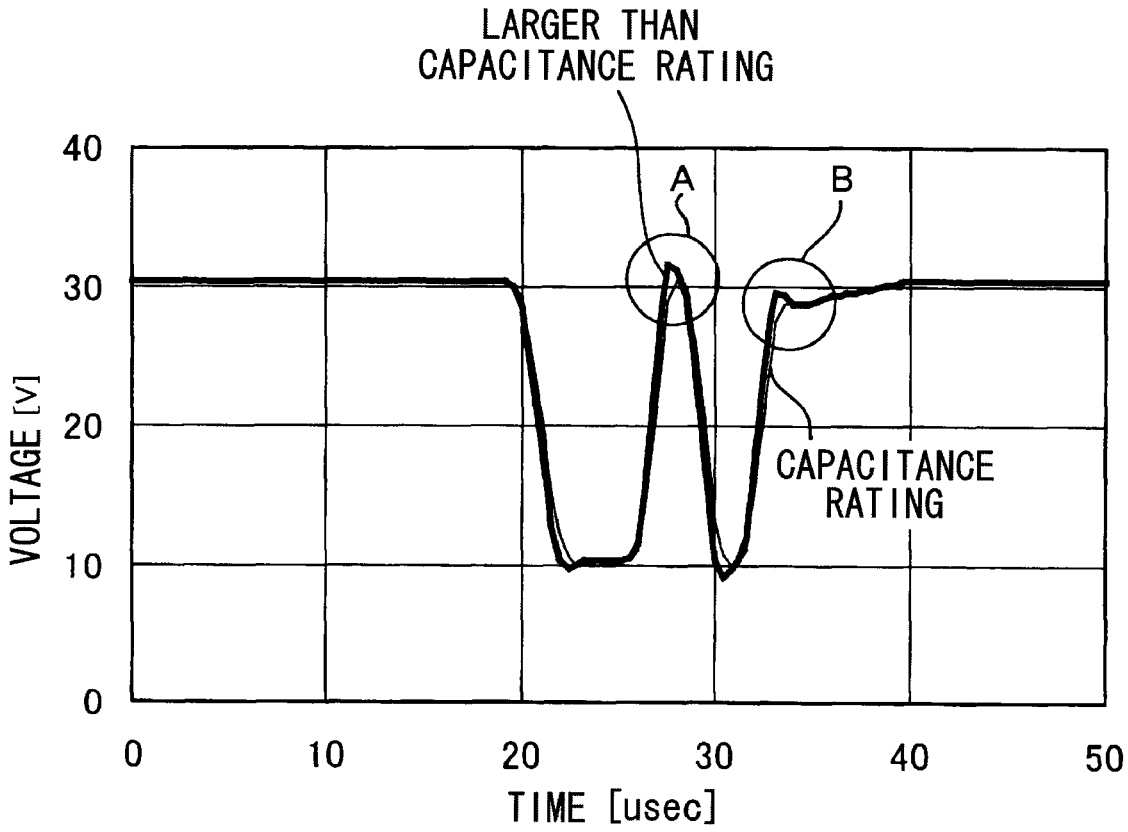
FIG. 14 is a graph showing an example of the analog driving signal according to the second exemplary embodiment.

FIG. 14 shows the time characteristics of the output of the analog driving signal when the digital signal $D_0$ is inputted to the system shown in FIG. 11. As shown in FIG. 14, when the magnitude of the capacitance $C_L$ is larger than the rating the voltage of the analog driving signal increases, as shown in regions A and B. This is because, the frequency characteristics changes when the capacitance $C_L$ is changed, as shown in FIG. 13.

Third Exemplary Embodiment

Hereafter, a third exemplary embodiment will be described, in which the digital driving signal is fed back based on the difference between the digital signal $D_0$ and the digital load voltage signal.

Figure 15:
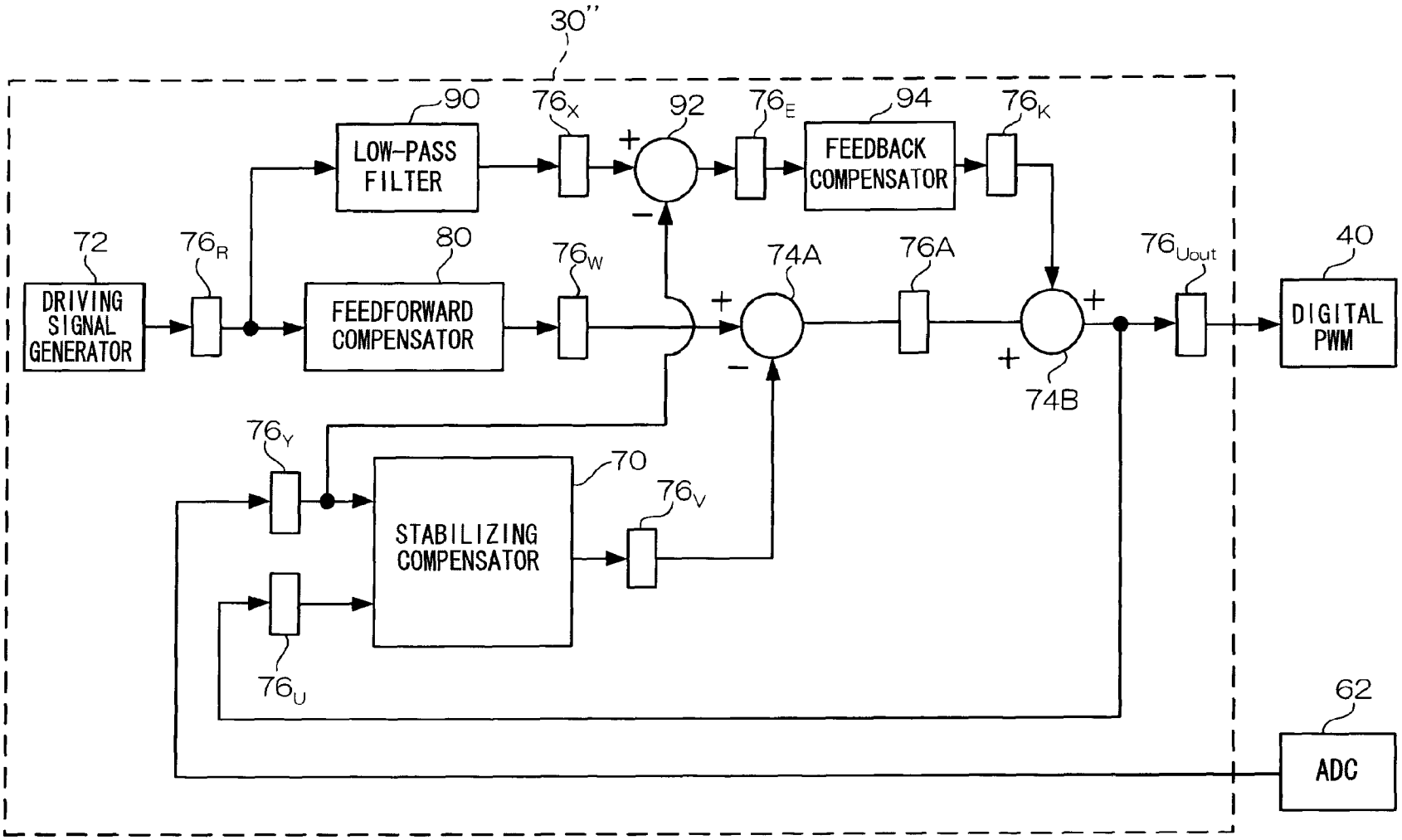
FIG. 15 is a diagram showing the configuration of a digital signal processing section according to a third exemplary embodiment.

Referring to FIG. 15, the essential configuration of the electric system of a digital signal processing section 30" according to the third exemplary embodiment will be described. The configurations of FIG. 15 that are the same to FIG. 9 are indicated by the same reference numerals as FIG. 9, and the description thereof will be omitted.

As shown in FIG. 15, the digital signal processing section 30" includes the low-pass filter 90, an error detector 92, a feedback compensator 94, and an adder-subtractor 74B.

The low-pass filter 90 is connected to the register $76_R$. When the digital signal $D_0$ is inputted from the register $76_R$, the low-pass filter 90 outputs a digital signal $D_N$ having a frequency that is lower than a predetermined frequency and stores in a register $\mathbf{76}_X$.

The error detector 92 is connected to the register $\mathbf{76}_X$ and the register $\mathbf{76}_Y$. The error detector 92 calculates the deviation between the digital signal $D_N$ inputted from the register $\mathbf{76}_X$ and the digital load voltage signal inputted from the register $\mathbf{76}_Y$. The error detector 92 outputs a digital signal $D_E$ that represents the deviation, and stores in a register $\mathbf{76}_E$.

The feedback compensator 94 is connected to the register $\mathbf{76}_E$. The feedback compensator 94 computes the digital signal $D_E$ inputted from the register $\mathbf{76}_E$. The feedback compensator 94 outputs a digital signal $D_K$ that represents the value that suppresses the deviation represented by the digital signal $D_E$ and stores digital signal $D_K$ in a register $\mathbf{76}_K$.

The feedback compensator 94 according to this exemplary embodiment performs a comparing computation (P computation), that calculates the value in proportion to the value presented by the digital signal $D_E$, as the computing process. However, the feedback compensator 94 according to this exemplary embodiment is not limited thereto, and may perform any one of an integrating computation (I computation), a differentiating computation (D computation), a computation combining the P computation and the I computation (PI computation), a computation combining the P computation and the D computation (PD computation), and a computation combining the P computation, the I computation, and the D computation (PID computation). The feedback compensator 94 according to this exemplary embodiment may combine other computing processes, such as a phase advancing process or a phase delaying process.

The adder-subtractor 74B is connected to the register $\mathbf{76}_K$ and a register $\mathbf{76}_A$ that stores a digital signal $D_A$ outputted from the adder-subtractor 74A. The adder-subtractor 74B adds the digital signal $D_K$ to the digital signal $D_A$ outputted from the register $\mathbf{76}_A$. The adder-subtractor 74B stores the signal derived by the addition in the register $\mathbf{76}_U$ and the register $\mathbf{76}_{Uout}$ as the digital driving signal.

Figure 16:
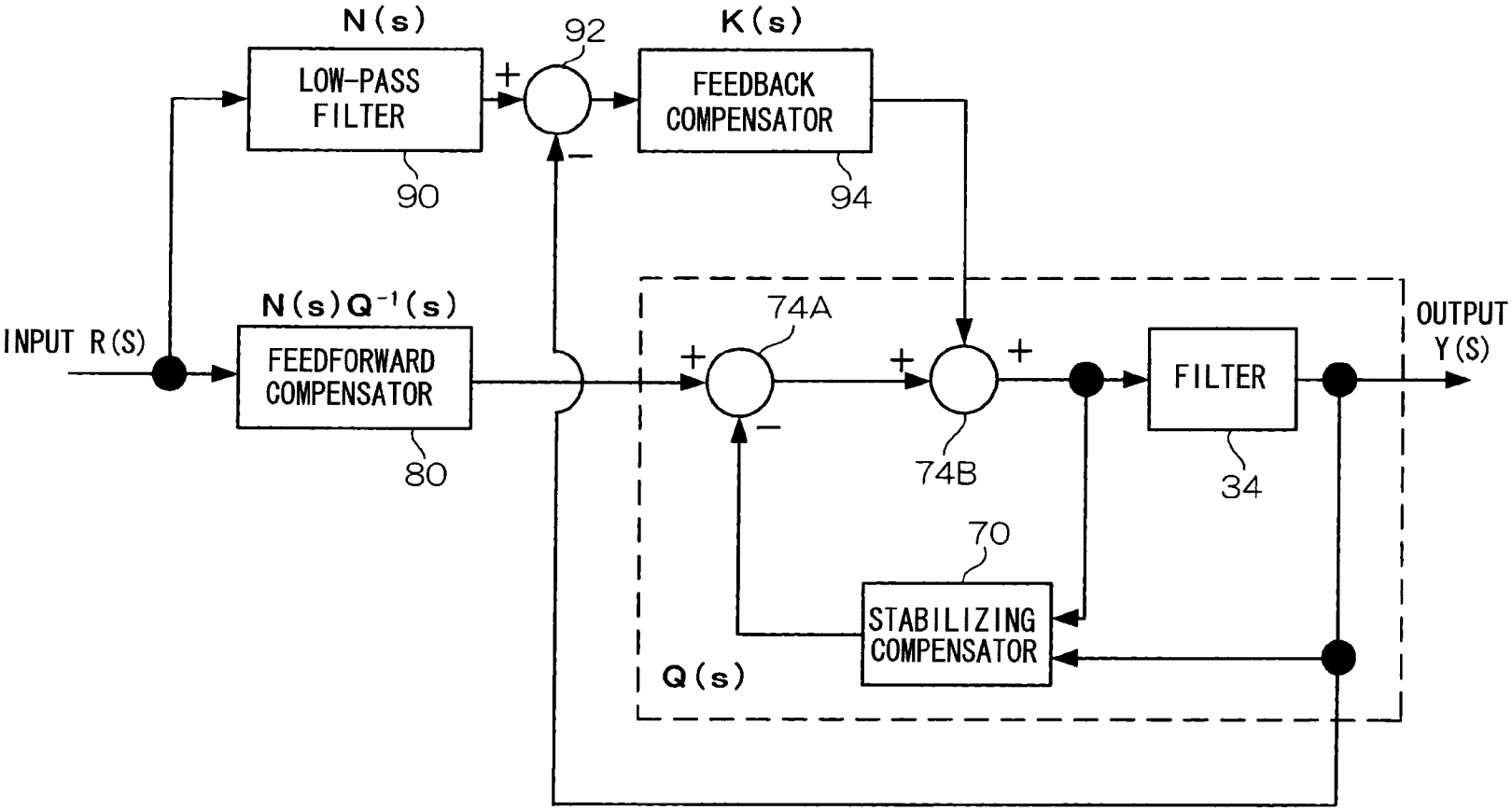
FIG. 16 is a diagram showing the transfer function of the driving circuit according to the third exemplary embodiment.

Hereafter, referring to FIG. 16, the transfer function from the input R(s) to the output Y(s) according to the third exemplary embodiment will be described.

When the transfer function of the feedback compensator 94 is set to K(s), the transfer function from the input R(s) to the output Y(s) can be expressed by Expression (13).

$$\frac{Y(s)}{R(s)} = N(s)\frac{K(s)Q(s)}{1+K(s)Q(s)} + D(s)\frac{Q(s)}{1+K(s)Q(s)} \tag{13}$$

Here, when the Expression (12) is substituted into the transfer function D(s) of Expression (13), Expression (13) can be expressed as the transfer function N(s) of the low-pass filter 90, as expressed in Expression (14).

$$\frac{Y(s)}{R(s)} = N(s) \tag{14}$$

Hereafter, the feedback in the third exemplary embodiment using the feedback compensator 94 will be described.

For example, when the capacitance $C_L$ of the piezoelectric device 11 fluctuates and the digital load voltage signal becomes larger than the digital signal $D_0$ outputted from the low-pass filter 90, the digital signal $D_E$ outputted from the error detector 92 expresses a negative value. Further, in the third exemplary embodiment, the load voltage is decreased by computing the digital signal $D_E$ by the feedback compensator 94, and by adding the digital signal $D_E$ to the digital signal $D_A$ output from the adder-subtractor 74A. Due thereto, as can be understood from Expression (14), the load voltage follows the digital signal $D_N$ outputted from the low-pass filter 90.

Figure 17:
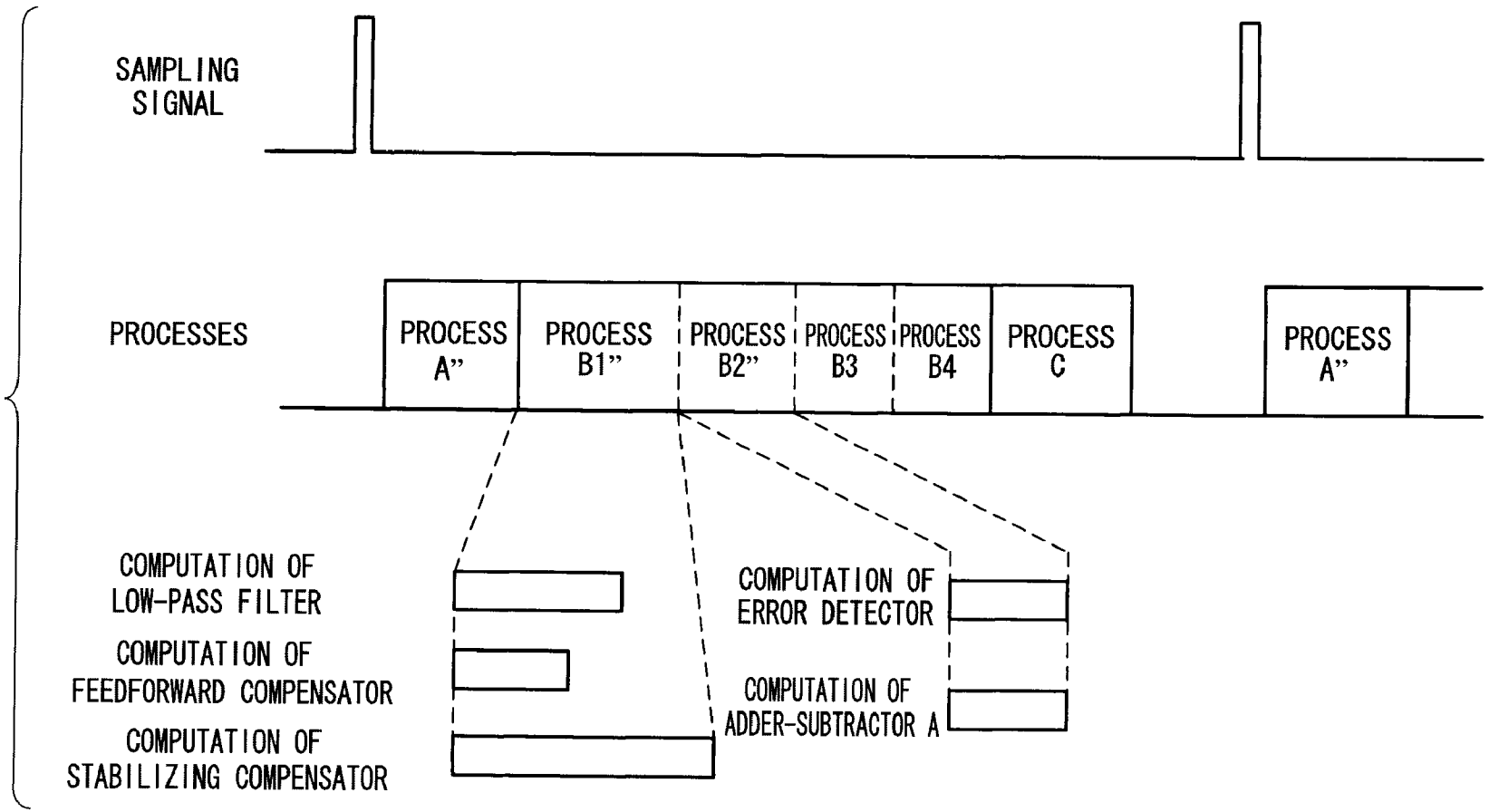
FIG. 17 is a diagram showing the order of processes according to the third exemplary embodiment.

Hereafter, referring to FIG. 17, the order of processes executed by the digital signal processing section 30" according to the third exemplary embodiment will be described. The processes of FIG. 17 that are the same of FIG. 7 are indicated by the same reference numerals as FIG. 7 and the description thereof will be omitted.

In process A", the digital load voltage signal stored in the register $\mathbf{76}_Y$ and the digital driving signal stored in the register $\mathbf{76}_U$ are outputted to the stabilizing compensator 70. With this, in process A", the digital signal $D_0$ stored in the register $\mathbf{76}_R$ is outputted to the feedforward compensator 80 and the low-pass filter 90. Then the routine proceeds to process B1".

In process B1", the digital load current signal is derived by the stabilizing compensator 70 by computation, and stored in the register $\mathbf{76}_V$. Also in process B1", the feedforward compensator 80 performs a computation that enhances the high frequency range of the digital signal $D_0$. Then, the digital signal $D_W$ derived by computation is stored in the register $\mathbf{76}_W$. Further, the low-pass filter 90 computes the digital signal $D_0$ for outputting the signal having a frequency lower than a predetermined frequency. The digital signal $D_N$ derived by the above computation is stored in the register $\mathbf{76}_N$. The computation by the stabilizing compensator 70, the computation by the feedforward compensator 80, and the computation by the low-pass filter 90 are executed in parallel. After the computations are completed, the routine proceeds to process B2".

In process B2", the digital load current signal stored in the register $\mathbf{76}_V$ and the digital signal $D_W$ stored in the register $\mathbf{76}_W$ are outputted to the adder-subtractor 74A. Then, the digital load current signal is subtracted from the digital signal $D_W$ by the adder-subtractor 74A. The digital signal $D_A$ derived by the subtraction is stored in the register $\mathbf{76}_A$. The digital load voltage signal stored in the register $\mathbf{76}_Y$ and the digital signal $D_N$ stored in the register $\mathbf{76}_N$ are outputted to the error detector 92. Further, the error detector 92 computes to calculate the deviation between the digital signal $D_N$ and the digital load voltage signal. Then, the digital signal $D_E$ derived by the above computation is stored in the register $\mathbf{76}_E$. Then, the routine proceeds to process B3. The computation by the adder-subtractor 74A and the computation by the error detector 92 are executed in parallel. After the computations are completed, the routine proceeds to the process B3.

In process B3, the digital signal $D_E$ stored in the register $\mathbf{76}_E$ is outputted to the feedback compensator 94. Subsequently, computation that suppresses a difference represented by the digital signal $D_E$ is performed by the feedback compensator 94. The digital signal $D_K$ derived by the above computation is stored in the register $\mathbf{76}_K$. Then, the routine proceeds to process B4.

In the process B4, the digital signal $D_A$ stored in the register $\mathbf{76}_A$ and the digital signal $D_K$ stored in the register $\mathbf{76}_K$ are outputted to the adder-subtractor 74B. The digital signal $D_K$ is added to the digital signal $D_A$ by the adder-subtractor 74B. The signal derived by the addition is stored in the register $\mathbf{76}_{Uout}$ as the digital driving signal. Then, the routine proceeds to the process C.

Figure 18:
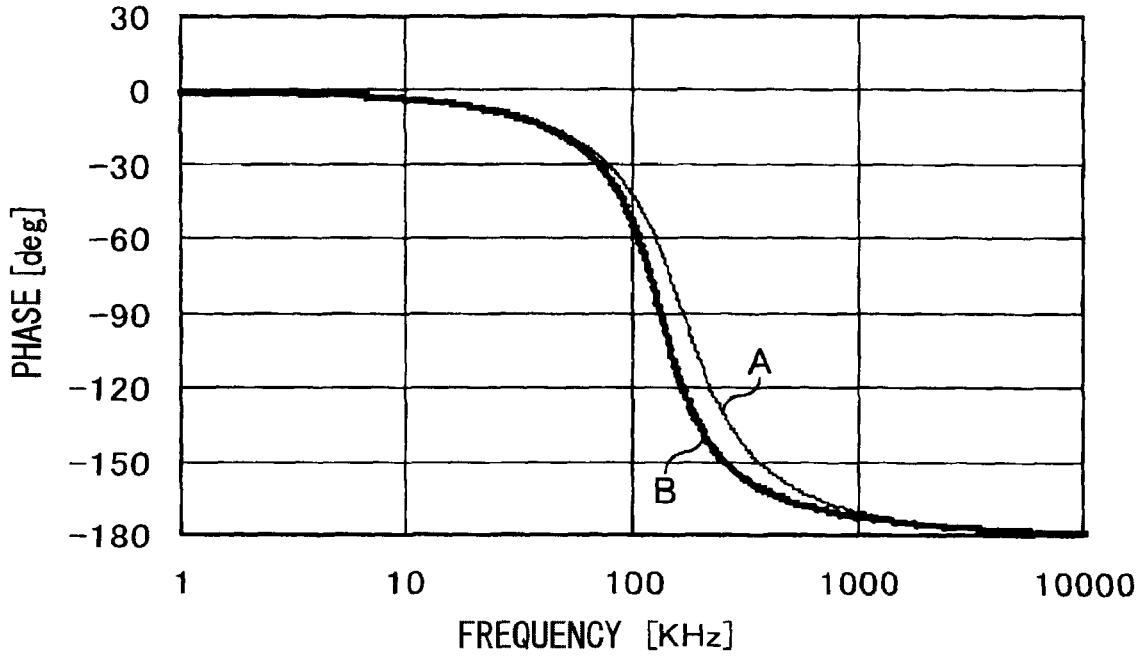
FIG. 18 is a diagram showing the phase characteristic of the stabilized control target Q(s) according to the third exemplary embodiment.

FIG. 18 shows the phase characteristics of the stabilized control target Q(s). As shown in FIG. 18, in the control target Q(s), a phase becomes further delayed as the frequency increases.

Since the control target Q(s) according to the third exemplary embodiment is included in the loop of feedback, when the delay of the phase of an input signal is close to 180°, vibration may occur. Due thereto, the feedback compensator 94 has the function of advancing the phase relative to the signal in the high frequency range. Note that, the gain characteristic of the feedback compensator 94 is the characteristic that enhances the high frequency range.

The characteristic that enhances the high frequency range is added to the feedback compensator according to this exemplary embodiment. As shown in FIG. 18, when the characteristic that enhances the high frequency range is added (line A), the delay of the phase in the high frequency range is suppressed, as compared with when the characteristic that enhances the high frequency range is not added (line B).

The driving circuit 21 according to the third exemplary embodiment having the low-pass filter 90 is described. However, the invention is not limited to this. The driving circuit 21 may be configured without including the low-pass filter 90. Further, the invention may be configured without including the feedforward compensator 80.

Fourth Exemplary Embodiment

Hereafter, a fourth exemplary embodiment, in which the ink jet printer 1 includes the plural piezoelectric heads 10, will be described.

Figure 19:
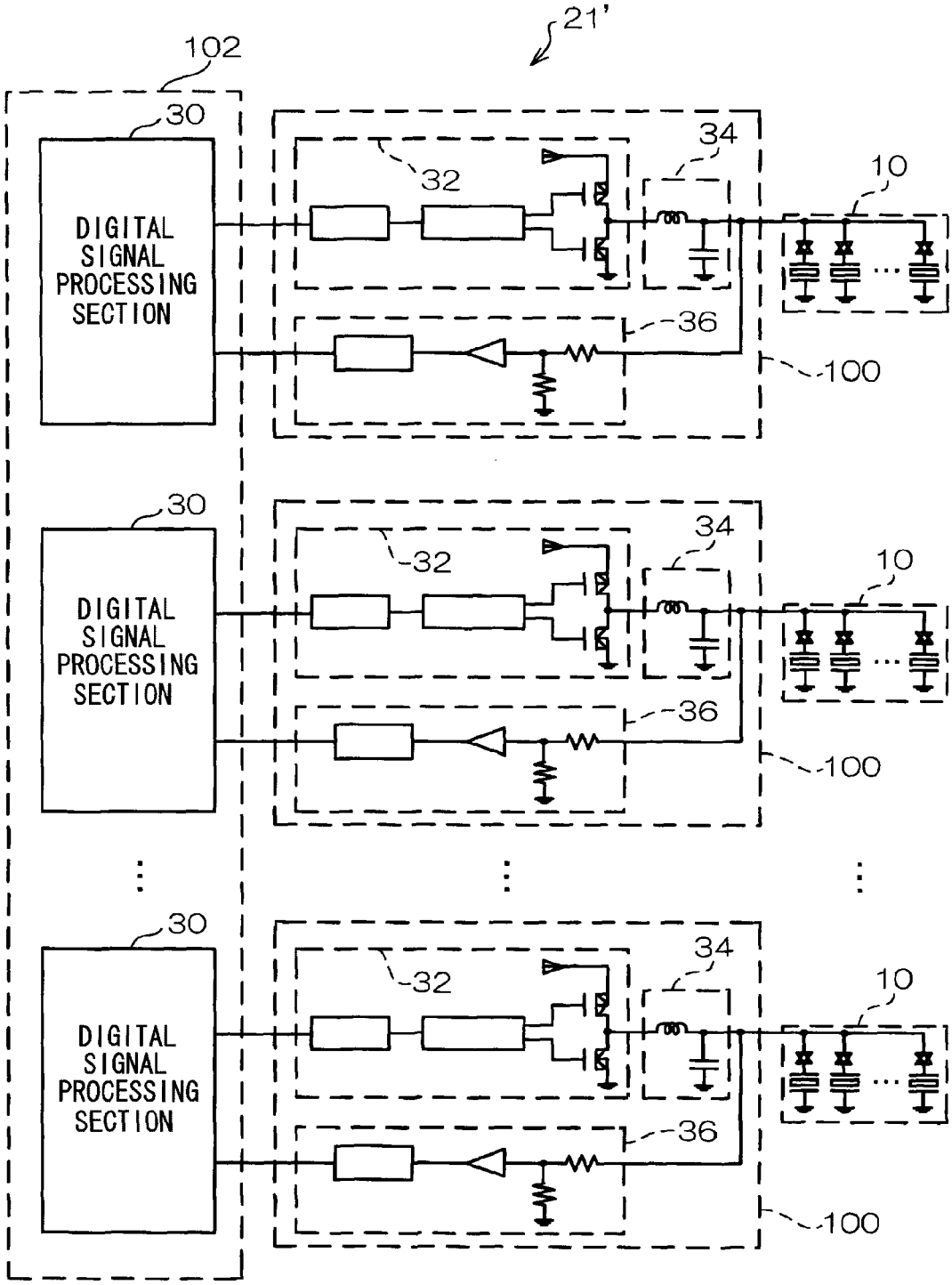
FIG. 19 is a diagram showing the configuration of the driving circuit according to a fourth exemplary embodiment.

FIG. 19 shows the configuration of the driving circuit 21' according to the fourth exemplary embodiment.

As shown in FIG. 19, the driving circuit 21' according to the fourth exemplary embodiment includes, for each of the plural piezoelectric heads 10, the switching voltage amplifying circuit 32, the filter 34, and the voltage detecting circuit 36 (hereinafter, generically called a "piezoelectric head driving section 100"). The driving circuit 21' according to the fourth exemplary embodiment includes the digital signal processing section 30 for each of the piezoelectric head driving sections 100.

The plural digital signal processing sections 30 according to this exemplary embodiment are configured as a single digital integrated circuit 102. However, the digital PWM 40 included in the switching voltage amplifying circuit 32 may be configured to be included in the digital integrated circuit 102.

Fifth Exemplary Embodiment

Hereafter, a fifth exemplary embodiment will be described, in which the plural analog driving signals are outputted to the piezoelectric device 11, and one of the analog driving signals is inputted to the piezoelectric device 11.

Figure 20:
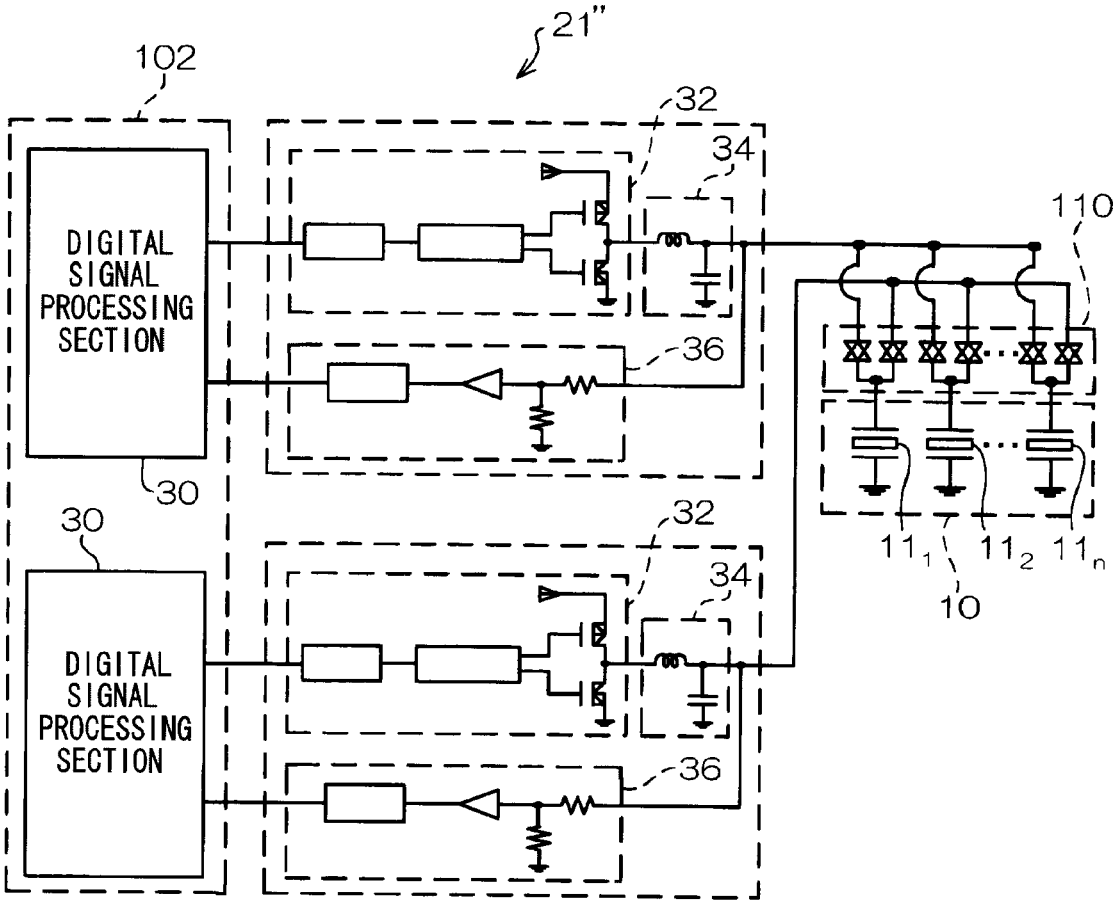
FIG. 20 is a diagram showing the configuration of a driving circuit according to a fifth exemplary embodiment.

FIG. 20 shows the configuration of a driving circuit 21" according to the fifth exemplary embodiment.

As shown in FIG. 20, the driving circuit 21" includes two sets of the digital signal processing sections 30 and the piezoelectric head driving sections 100. The two sets of the digital signal processing sections 30 and the piezoelectric head driving sections 100, outputs the different analog driving signals to the piezoelectric device 11, respectively.

A driving signal selecting section 110 includes, for each of the piezoelectric devices 11, a switch for switching the analog driving signal inputted to the piezoelectric device 11. The driving signal selecting section 110 switches the switch to output one of the plural analog driving signals outputted from the plural driving circuits 21" to the piezoelectric device 11.

The driving circuit 21" according to this exemplary embodiment includes two sets of the digital signal processing sections 30 and the piezoelectric head driving sections 100. The two sets of the digital signal processing sections 30 and the piezoelectric head driving sections 100, outputs two analog driving signals to the piezoelectric head 10. However, the invention is not limited to this. The invention may include three or more sets of the digital signal processing sections 30 and the piezoelectric head driving sections 100 and may output three or more analog driving signals to the piezoelectric head 10.

The ink jet printer 1 may be configured to include two or more piezoelectric heads 10 to output two or more analog driving signals to each of the piezoelectric heads 10.

The present invention is described above using the exemplary embodiments. However, the scope of the invention is not limited to the descriptions in the exemplary embodiments. Various modifications or improvements may be added to the exemplary embodiments without departing from the purport of the invention. Note that, the forms of which the modifications or improvements are added are included in the scope of the invention.

The exemplary embodiments do not limit the invention according to the claims. All of the combinations of the features described in the exemplary embodiments are not always essential in the addressing part of the invention. Inventions at various stages are included in the exemplary embodiments. Various inventions may be extracted by the combinations in the plural disclosed configuration requirements. Even if some configuration requirements are deleted from all the configuration requirements shown in the exemplary embodiments, as long as the effects may be derived, the configuration from which some configuration requirements are deleted may be extracted as the invention.

In the exemplary embodiments, the process of the digital signal processing section 30 is realized by a hardware configuration. However, the invention is not limited to this. The process of the digital signal processing section 30 may be realized by a software configuration using a computer by executing a program.

Figure 21:
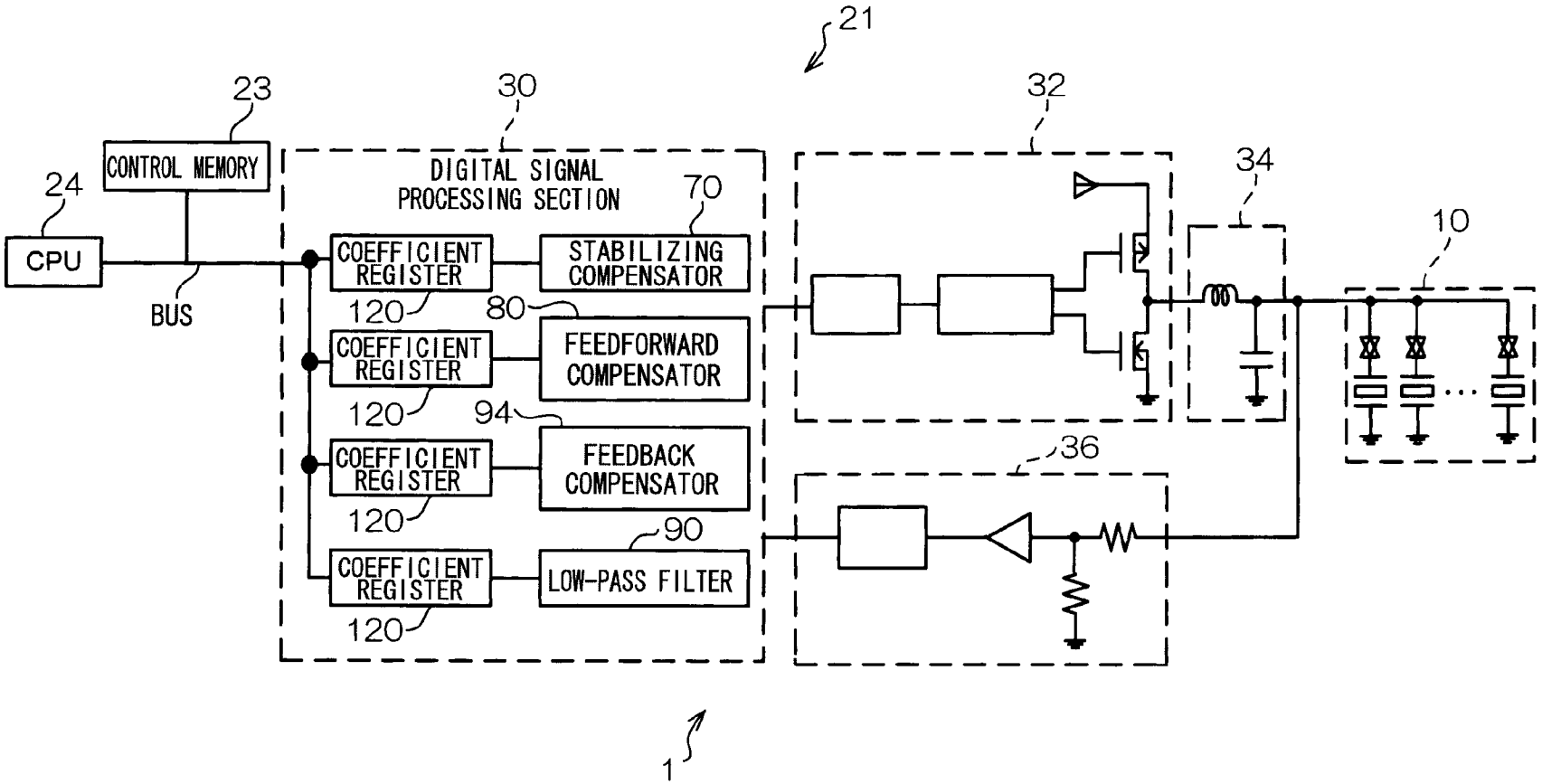
FIG. 21 is a diagram showing the configuration of the driving circuit including coefficient registers.

In the exemplary embodiments, as shown in the schematic diagram of FIG. 21, a coefficient register 120 that stores the coefficient used in each of the computations is included for each of the stabilizing compensator 70, the feedforward compensator 80, the feedback compensator 94, and the low-pass filter 90. Further, plural coefficients used in each of the computations are stored in the control memory 23. Therefore, when the coefficient used in each of the computations is set, the CPU 24 reads the coefficient from the control memory 23 and stores the read coefficient in the coefficient register 120.

Further, the configuration of the ink jet printer 1 described in the exemplary embodiments (see FIGS. 1, 4, 6, 9, 15, and 19 to 21) is an example. Accordingly, the unnecessary portions may be deleted, thus new portions may be added in the scope without departing from the purport of the invention.

What is claimed is:

1. A capacitive load driving circuit comprising:

a filter that includes an inductor, an analog driving signal being input to one end of the inductor, and a capacitor with a fixed capacitance having one electrode connected to the other end of the inductor and the other electrode connected to ground;

a plurality of capacitive loads connected in parallel to the capacitor, any of which may be driven in accordance with the analog driving signal input to one end of the inductor;

a conversion section that converts a load voltage output from the other end of the inductor to a digital signal;

a signal processing section that generates a predetermined signal for driving the capacitive load, derives a signal representing a magnitude of an electric current flowing to the capacitive load based on the digital signal and a digital driving signal, subtracts the signal representing the magnitude of an electric current from the predetermined signal, and outputs the subtracted signal as the digital driving signal; and a switching section that generates the analog driving signal by performing switching based on the digital driving signal, and that outputs the analog driving signal to one end of the inductor.

2. The capacitive load driving circuit of claim 1, wherein the signal processing section, by using the load voltage converted to a digital signal by the conversion section and a voltage represented by the digital driving signal, calculates a value proportionate to the magnitude of an electric current flowing to the capacitive load, from the following expression (1)

$$\frac{dx}{dt} = Ax + Bu \tag{1}$$

where, $x_1$ represents the load voltage, $x_2$ represents the value proportionate to the magnitude of an electric current flowing to the capacitive load, x represents a state vector configured by $x_1$ and $x_2$, u represents the voltage represented by the digital driving signal, A is a coefficient that represents a system matrix determined by the capacitance of the capacitor and the capacitive load, and the inductor, and B is a coefficient that represents the relation between the load voltage and the state vector.

3. The capacitive load driving circuit of claim 2, further comprising:

a storage section that stores the values of the coefficient A and the coefficient B;

wherein the signal processing section calculates the value proportionate to the magnitude of an electric current flowing to the capacitive load, by using any one of the values of the coefficient A and the coefficient B stored in the storing section.

4. The capacitive load driving circuit of claim 1, further comprising:

an enhancing section that receives the predetermined signal and which, with respect to the predetermined signal, enhances the frequency range of the analog driving signal suppressed by the filter, wherein the signal processing section subtracts the derived signal representing the magnitude of an electric current from a signal output from the enhancing section, and outputs the subtracted signal to the switching section as the digital driving signal.

5. The capacitive load driving circuit of claim 1, further comprising:

a feedback compensation section that receives a deviation between the predetermined signal and the load voltage converted to a digital signal and outputs a signal representing a value that suppresses the deviation, wherein the signal processing section adds a signal output from the feedback compensation section to the subtracted signal, and outputs the added signal to the switching section as the digital driving signal.

6. The capacitive load driving circuit of claim 5, further comprising:

a filter section that receives the predetermined signal and which outputs a signal that has a frequency lower than a predetermined frequency, wherein the feedback compensation section receives a difference in voltage between a signal output from the filter section and the load voltage converted to a digital signal.

7. A liquid droplet jetting apparatus comprising:

a piezoelectric head that comprises a plurality of capacitive loads and that discharges a liquid stored in a pressure chamber by changing a load voltage applied to the respective capacitive loads; and a capacitive load driving circuit that drives the capacitive loads provided in the piezoelectric head, the a capacitive load driving circuit including:

a filter that includes an inductor, an analog driving signal being input to one end of the inductor, and a capacitor with a fixed capacitance having one electrode connected to the other end of the inductor and the other electrode connected to ground;

a plurality of capacitive loads connected in parallel to the capacitor, any of which may be driven in accordance with the analog driving signal input to one end of the inductor;

a conversion section that converts a load voltage output from the other end of the inductor to a digital signal;

a signal processing section that generates a predetermined signal for driving the capacitive load, derives a signal representing a magnitude of an electric current flowing to the capacitive load based on the digital signal and a digital driving signal, subtracts the signal representing the magnitude of an electric current from the predetermined signal, and outputs the subtracted signal as the digital driving signal; and a switching section that generates the analog driving signal by performing switching based on the digital driving signal, and that outputs the analog driving signal to one end of the inductor.

8. A liquid droplet jetting apparatus comprising:

a piezoelectric head that comprises a plurality of capacitive loads and that discharges a liquid stored in a pressure chamber by changing a load voltage applied to the respective capacitive loads;

a plurality of capacitive load driving circuits that output different analog driving signals to the respective capacitive load driving circuits including:

a filter that includes an inductor, an analog driving signal being input to one end of the inductor, and a capacitor with a fixed capacitance having one electrode connected to the other end of the inductor and the other electrode connected to ground;

a plurality of capacitive loads connected in parallel to the capacitor, any of which may be driven in accordance with the analog driving signal input to one end of the inductor;

a conversion section that converts a load voltage output from the other end of the inductor to a digital signal;

a signal processing section that generates a predetermined signal for driving the capacitive load, derives a signal representing a magnitude of an electric current flowing to the capacitive load based on the digital signal and a digital driving signal, subtracts the signal representing the magnitude of an electric current from the predetermined signal, and outputs the subtracted signal as the digital driving signal; and a switching section that generates the analog driving signal by performing switching based on the digital driving signal, and that outputs the analog driving signal to one end of the inductor; and an outputting section that outputs one of a plurality of analog driving signals output from the plurality of capacitive load driving circuits to a capacitive load.

9. A capacitive load driving method, the capacitive load including a filter that includes an inductor, an analog driving signal being input to one end of the inductor, and a capacitor with a fixed capacitance having one electrode connected to the other end of the inductor and the other electrode connected to ground and a plurality of capacitive loads connected in parallel to the capacitor, any of which may be driven in accordance with the analog driving signal input to one end of the inductor, the method comprising:

converting a load voltage, output from the other end of the inductor, to a digital signal;

generating a predetermined signal for driving the capacitive load;

deriving a signal that represents the magnitude of an electric current flowing to the capacitive load based on the digital signal and a digital driving signal;

subtracting the derived signal that represents the magnitude of an electric current from the predetermined signal;

outputting the subtracted signal as the digital driving signal;

generating the analog driving signal by switching based on the digital driving signal; and outputting the analog driving signal to one end of the inductor.

* * * * *